US007446745B2

(12) United States Patent
Morita

(10) Patent No.: US 7,446,745 B2
(45) Date of Patent: Nov. 4, 2008

(54) DISPLAY DRIVER, DISPLAY DEVICE, AND DRIVER METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 685 days.

(21) Appl. No.: 10/891,146

(22) Filed: Jul. 15, 2004

(65) Prior Publication Data

US 2005/0052890 A1 Mar. 10, 2005

(30) Foreign Application Priority Data

Jul. 18, 2003 (JP) ..... 2003-277029

(51) Int. Cl.
*G09G 3/36* (2006.01)

(52) U.S. Cl. ..... 345/92; 345/90

(58) Field of Classification Search ..... 345/87–102, 345/74.1–83, 211–213, 204, 60
See application file for complete search history.

(56) References Cited

U.S. PATENT DOCUMENTS

| | | | | |
|---|---|---|---|---|
| 5,781,171 | A * | 7/1998 | Kihara et al. | 345/93 |
| 6,181,314 | B1 * | 1/2001 | Nakajima et al. | 345/100 |
| 6,492,970 | B1 * | 12/2002 | Furuhashi et al. | 345/94 |
| 6,509,895 | B2 * | 1/2003 | Yanagi et al. | 345/211 |
| 7,006,057 | B2 * | 2/2006 | Jin et al. | 345/60 |
| 7,173,614 | B2 | 2/2007 | Morita | |
| 2002/0105492 | A1 * | 8/2002 | Kosaka | 345/89 |
| 2003/0151577 | A1 * | 8/2003 | Morita | 345/89 |
| 2005/0057470 | A1 * | 3/2005 | Tobita | 345/89 |
| 2005/0078078 | A1 | 4/2005 | Morita | |
| 2005/0088387 | A1 * | 4/2005 | Yokoyama et al. | 345/87 |

FOREIGN PATENT DOCUMENTS

| | | |
|---|---|---|
| JP | 10-11032 | 1/1998 |
| JP | 2002-229525 | 8/2002 |

* cited by examiner

*Primary Examiner*—Nitin Patel
(74) *Attorney, Agent, or Firm*—Oliff & Berridge, PLC

(57) ABSTRACT

A display driver including: a data line driver circuit which drives an output line based on a drive voltage corresponding to display data; a first switching element connected between a first power supply line and the output line; a second switching element connected between a second power supply line and the output line; and a switch control circuit which controls the first and second switching elements. The lengths of first and second periods are determined based on at least part of the display data in a horizontal scanning period which is immediately before a current horizontal scanning period. The first and second switching elements are respectively turned ON and OFF in the first period, and are respectively turned OFF and ON in the second period. After the second period, the first and second switching elements are turned OFF, and the output line is driven by the data line driver circuit.

27 Claims, 26 Drawing Sheets

FIG. 12

| D5 | D4 | D3 | D2 | D1 | D0 | GRAY-SCALE VALUE | |
|---|---|---|---|---|---|---|---|
| 1 | 1 | 1 | 1 | 1 | 1 | 63 | D5=1 |
| 1 | 1 | 1 | 1 | 1 | 0 | 62 | |
| ⋮ | ⋮ | ⋮ | ⋮ | ⋮ | ⋮ | ⋮ | |
| 1 | 0 | 0 | 0 | 0 | 0 | 32 | |
| 0 | 1 | 1 | 1 | 1 | 1 | 31 | D5=0 |
| ⋮ | ⋮ | ⋮ | ⋮ | ⋮ | ⋮ | ⋮ | |
| 0 | 0 | 0 | 0 | 0 | 1 | 1 | |
| 0 | 0 | 0 | 0 | 0 | 0 | 0 | |

FIG. 25

| RD5 | GD5 | BD5 | REGISTER GROUP |
|---|---|---|---|
| 0 | 0 | 0 | REG1 |
| 0 | 0 | 1 | REG1 |
| 0 | 1 | 0 | REG1 |
| ⋮ | ⋮ | ⋮ | ⋮ |
| 1 | 0 | 1 | REG2 |
| 1 | 1 | 0 | REG2 |
| 1 | 1 | 1 | REG2 |

DISPLAY DRIVER, DISPLAY DEVICE, AND DRIVER METHOD

Japanese Patent Application No. 2003-277029, filed on Jul. 18, 2003, is hereby incorporated by reference in its entirety.

BACKGROUND OF THE INVENTION

The present invention relates to a display driver, a display device, and a drive method.

A precharge technology which increases the liquid crystal drive speed of an active matrix type liquid crystal display device (display device in a broad sense) is known. In this precharge technology, a data line is precharged to a predetermined potential before driving the data line based on display data to reduce the amount of charging/discharging of the data line accompanying supply of a drive voltage based on the display data.

This precharge technology is disclosed in Japanese Patent Application Laid-open No. 10-11032 and Japanese Patent Application Laid-open No. 2002-229525, for example. In Japanese Patent Application Laid-open No. 10-11032, different direct-current potentials are provided in advance, and a switch is provided between the direct-current potentials and the data line. This precharge technology controls connection between the direct-current potentials provided in advance and the data line by controlling the switch corresponding to the polarity of liquid crystal reversal drive. According to this precharge technology, the amount of charging/discharging of the data line accompanying drive is small even if the precharge cycle is reduced, whereby an increase in power consumption can be prevented and an accurate voltage can be supplied to the data line.

Japanese Patent Application Laid-open No. 2002-229525 discloses a technology of controlling supply of a precharge voltage corresponding to the result of a comparison between display data for the preceding and current horizontal scanning periods. This enables precharging to be omitted depending on the drive voltage in the horizontal scanning period before precharging. Therefore, precharging is not necessarily performed irrespective of the drive voltage in the horizontal scanning period before precharging, whereby power consumption accompanying a change in potential of the data line can be reduced.

BRIEF SUMMARY OF THE INVENTION

According to one aspect of the present invention, there is provided a display driver which drives a data line of a display panel, the display driver comprising:

a data line driver circuit which drives an output line connected to the data line by a drive voltage corresponding to display data;

a first switching element connected between the output line and a first power supply line to which a first power supply voltage is supplied;

a second switching element connected between the output line and a second power supply line to which a second power supply voltage is supplied; and a switch control circuit which controls the first and second switching elements, wherein:

the lengths of a first period and a second period after the first period are determined based on at least part of display data in a horizontal scanning period which is immediately before a current horizontal scanning period;

the switch control circuit electrically connects the output line to the first power supply line in the first period by setting the first switching element in an ON state and setting the second switching element in an OFF state;

the switch control circuit electrically connects the output line to the second power supply line in the second period by setting the first switching element in an OFF state and setting the second switching element in an ON state;

the switch control circuit sets the first and second switching elements in an OFF state after the second period; and the data line driver circuit drives the output line after the second period.

BRIEF DESCRIPTION OF THE SEVERAL VIEWS OF THE DRAWING

FIG. 12 shows gray-scale values represented by six bits of display data.

FIG. 25 is a truth table of a decoder circuit included in a switch control circuit according to one embodiment of the present invention.

DETAILED DESCRIPTION OF THE EMBODIMENTS

Figure 1:
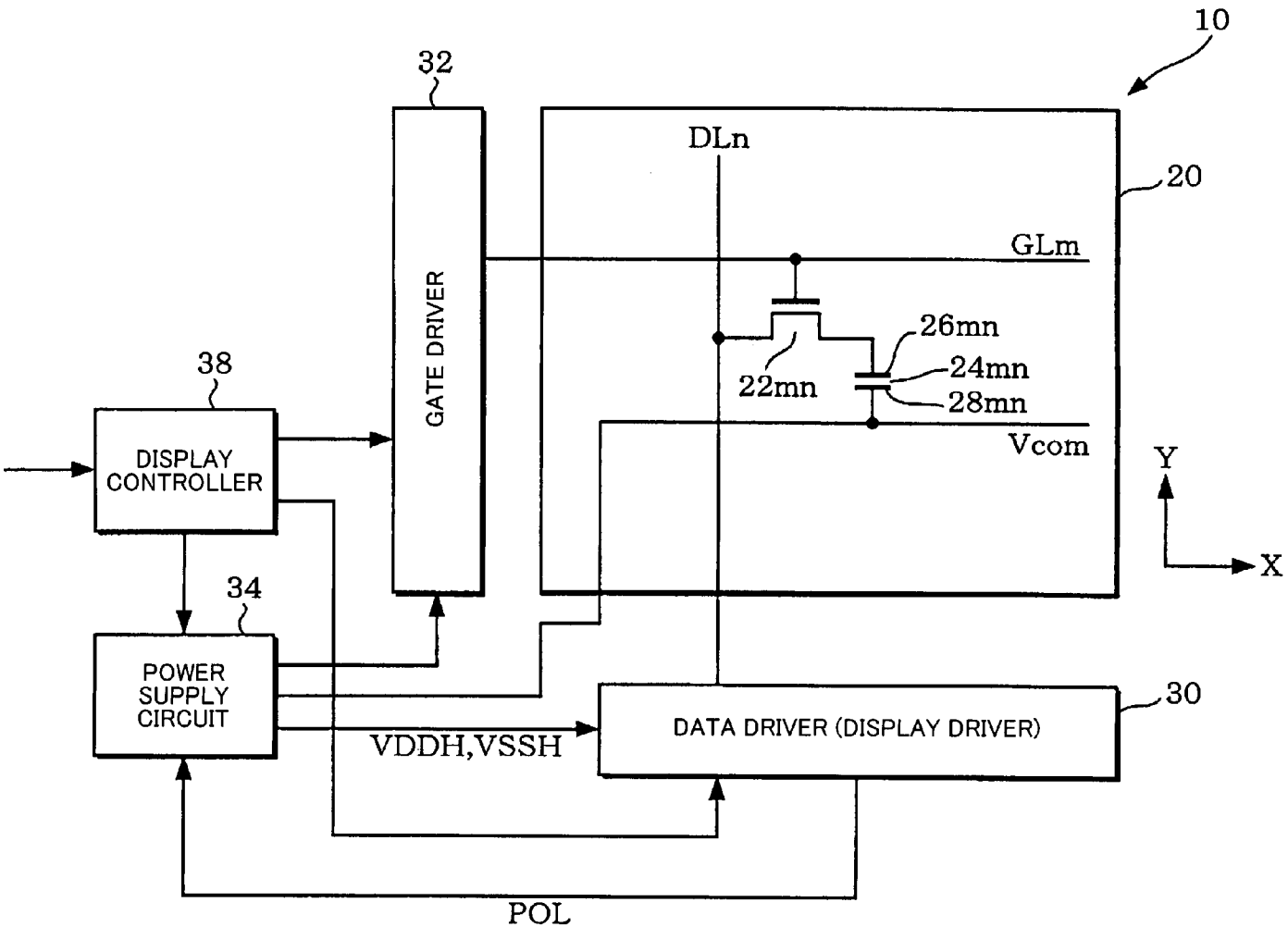
FIG. 1 is a block diagram schematically showing configuration of a display device including the display driver according to one embodiment of the present invention.

Embodiments of the present invention are described below. Note that the embodiments described below do not in any way limit the scope of the invention laid out in the claims herein. In addition, all of the elements of the embodiments described below should not be taken as essential requirements of the present invention.

The switch connected between the direct-current potential and the data line may be formed by a metal-oxide semiconductor (MOS) transistor in order to perform the above-described precharging. However, the charge/discharge time of the data line is increased as the voltage applied between the source and drain of the MOS transistor is decreased. Therefore, the precharge technology disclosed in Japanese Patent Application Laid-open No. 10-11032 and Japanese Patent Application Laid-open No. 2002-229525 may not cause electric charges stored in the data line to be completely discharged, since the direct-current potential provided in advance and the data line are connected corresponding to the polarity of the liquid crystal reversal drive. In this case, the data line may not be set at a desired potential, thereby causing the display quality to deteriorate.

Japanese Patent Application Laid-open No. 10-11032 discloses that the charge/discharge speed of the data line is increased by increasing the difference between the potential of the data line and the precharge potential. However, a large amount of potentials are necessary for driving the liquid crystal and additional precharge potential increases the circuit scale. Furthermore, power consumption is significantly increased by simply connecting the data line with the precharge potential.

In the technology disclosed in Japanese Patent Application Laid-open No. 2002-229525, since a circuit which compares the display data in the horizontal scanning period immediately before the current horizontal scanning period with the display data in the current horizontal scanning period is necessary for each data line, the circuit scale is increased. In particular, it may be impossible to deal with an increase in the number of data lines accompanying an increase in the size of the display panel in the future.

According to the following embodiments, a display driver, a display device, and a drive method which can drive the data line by using the precharge technology while preventing an increase in circuit scale, reducing power consumption, and preventing deterioration of the display quality can be provided.

According to one embodiment of the present invention, there is provided a display driver which drives a data line of a display panel, the display driver comprising:

a data line driver circuit which drives an output line connected to the data line by a drive voltage corresponding to display data;

a first switching element connected between the output line and a first power supply line to which a first power supply voltage is supplied;

a second switching element connected between the output line and a second power supply line to which a second power supply voltage is supplied; and a switch control circuit which controls the first and second switching elements, wherein:

the lengths of a first period and a second period after the first period are determined based on at least part of display data in a horizontal scanning period which is immediately before a current horizontal scanning period;

the switch control circuit electrically connects the output line to the first power supply line in the first period by setting the first switching element in an ON state and setting the second switching element in an OFF state;

the switch control circuit electrically connects the output line to the second power supply line in the second period by setting the first switching element in an OFF state and setting the second switching element in an ON state;

the switch control circuit sets the first and second switching elements in an OFF state after the second period; and the data line driver circuit drives the output line after the second period.

In this display driver, the data line is precharged in each of the first and second periods before the data line is driven by the data line driver circuit. Therefore, the charge/discharge time of the data line is reduced by the precharge technology, whereby deterioration of the display quality can be prevented.

Moreover, since the data line is precharged in two stages, the amount of electric charges flowing from the data line into the second power supply line during charging/discharging of the data line can be minimized, for example. In particular, when the second power supply voltage of the second power supply line is a system ground power supply voltage, positive charges flow toward the system ground side, so that power consumption is increased. A precharge method in which the data line is merely connected to the potential provided in advance causes electric charges to flow into the second power supply line during charging/discharging of the data line, whereby power consumption is increased. However, according to this embodiment of the present invention, the amount of electric charges flowing into the second power supply line can be minimized by precharging the data line to the first power supply voltage, so power consumption can be reduced.

Furthermore, the lengths of the first and second periods of precharging are determined based on at least part of the display data in a horizontal scanning period immediately before the current horizontal scanning period. Therefore, power consumption can be reduced by increasing the first period when the potential change of the data line by the polarity inversion drive is small, for example. When the potential change of the data line by the polarity inversion drive is large, the data line is caused to promptly reach a desired potential by increasing the second period, whereby deterioration of the display quality can be prevented. A display driver which improves the display quality and reduces power consumption can be provided by performing such a strict precharge control.

According to one embodiment of the present invention, there is provided a display driver which drives a plurality of data lines of a display panel, the display panel including: a plurality of scanning lines; the data lines; a plurality of pixels each of which is connected to one of the scanning lines and one of the data lines; and a plurality of demultiplexers each of which includes first to third demultiplex switching elements which are respectively and exclusively controlled by first to third demultiplex control signals, one end of each of the first to third demultiplex switching elements being connected to one of data signal supply lines to which time-divided drive voltages corresponding to first to third color component data are supplied, and the other end of each of the first to third demultiplex switching elements being connected to one of the pixels for a jth color component ($1 \leqq j \leqq 3$, j is an integer), the display driver comprising:

a data line driver circuit which drives an output line connected to the data signal supply lines by the drive voltages;

a first switching element connected between the output line and a first power supply line to which a first power supply voltage is supplied;

a second switching element connected between the output line and a second power supply line to which a second power supply voltage is supplied; and a switch control circuit which controls the first and second switching elements, wherein:

the lengths of a first period and a second period after the first period are determined based on at least part of one of the first to third color component data in display data in a horizontal scanning period which is immediately before a current horizontal scanning period;

the switch control circuit electrically connects the output line to the first power supply line in the first period by setting the first switching element in an ON state and setting the second switching element in an OFF state;

the switch control circuit electrically connects the output line to the second power supply line in the second period by setting the first switching element in an OFF state and setting the second switching element in an ON state;

the switch control circuit sets the first and second switching elements in an OFF state after the second period; and the data line driver circuit drives the output line after the second period.

A display driver which enables a strict precharge control of the data line of a display panel formed by a low-temperature poly-silicon process, and achieves improvement of the display quality and reduction of power consumption can be thus provided.

In this display driver, an absolute value of a difference between the voltage of the data line and the first power supply voltage at the start of the first period may be smaller than an absolute value of a difference between the voltage of the data line and the second power supply voltage at the start of the first period.

When the data line is driven at a low potential, the data line is precharged to a higher potential and is then precharged to a lower potential. Therefore, since the period in which positive charges flow toward a lower potential can be reduced, power consumption can be reduced by reutilizing electric charges due to precharging to a higher potential. Moreover, since the data line is precharged to a lower potential before the data line is driven based on the display data, an accurate voltage can be supplied to the data line even if the precharge cycle is shortened, an increase in the display size can be well managed and deterioration of the display quality can be prevented.

When the data line is driven at a high potential, the data line is precharged to a lower potential and is then precharged to a higher potential. Therefore, since the period in which negative charges flow toward a higher potential can be reduced, power consumption can be reduced by reutilizing electric charges due to precharging to a lower potential. Moreover, since the data line is precharged to a higher potential before the data line is driven based on the display data, an accurate voltage can be supplied to the data line even if the precharge cycle is shortened.

In this display driver, the switch control circuit may control the first and second switching elements so that the first period is longer than the second period.

Since the amount of electric charges consumed by charging/discharging of the data line can be reduced, power consumption can be further reduced.

In this display driver, the first power supply voltage may be higher than the second power supply voltage; a first precharge period may be provided before a drive period in which a polarity of the drive voltage is negative with respect to a reference potential; a second precharge period may be provided before a drive period in which a polarity of the drive voltage is positive with respect to the reference potential; the switch control circuit may set the first switching element in an ON state and set the second switching element in an OFF state in a first divisional period within the first precharge period; the switch control circuit may set the first switching element in an OFF state and set the second switching element in an ON state in a second divisional period after the first divisional period; the switch control circuit may set the first switching element in an OFF state and set the second switching element in an ON state in a third divisional period within the second precharge period; and the switch control circuit may set the first switching element in an ON state and set the second switching element in an OFF state in a fourth divisional period after the third divisional period.

This makes it possible to reduce power consumption accompanying charging/discharging of the data line by the polarity inversion drive, and to prevent deterioration of the display quality.

In this display driver, the switch control circuit may include $2^K$(K is a natural number) sets of registers, each of the sets including first to fourth divisional period setting registers; the switch control circuit may select one of the $2^K$ sets of registers based on higher-order K bits of the display data in a horizontal scanning period which is immediately before a current horizontal scanning period; and the switch control circuit may control the first and second switching elements in each of the first to fourth divisional periods corresponding to values set in the first to fourth divisional period setting registers of the selected set.

Since the first to fourth divisional periods corresponding to the values set in the first to fourth divisional period setting registers in the register set selected based on the gray-scale value represented by the display data in a horizontal scanning period immediately before the current horizontal scanning period, a strict precharge control can be performed and the precharge control can be simplified.

In this display driver, the switch control circuit may control the first and second switching elements so that the first divisional period is longer than the second divisional period and the third divisional period is longer than the fourth divisional period.

Since the amount of electric charges consumed by charging/discharging of the data line can be reduced, power consumption can be further reduced.

In this display driver, the first power supply voltage may be a power supply voltage on the high-potential-side of the data line driver circuit; and the second power supply voltage may be a power supply voltage on the low-potential-side of the data line driver circuit.

In this display driver, the first power supply voltage may be a maximum value of the drive voltage; and the second power supply voltage may be a minimum value of the drive voltage.

Sine it is unnecessary to provide an additional precharge potential, an increase in the circuit scale of the display driver can be prevented.

In this display driver, the first power supply voltage may be higher than the second power supply voltage;

a first precharge period may be provided before a drive period in which a polarity of the drive voltages are negative with respect to a reference potential;

a second precharge period may be provided before a drive period in which a polarity of the drive voltages are positive with respect to the reference potential;

each of the first and second precharge periods may include a period in which each of the data signal supply lines is electrically connected to one of the data lines, each of the data lines being connected to one of the pixels for first to third color components by the first to third demultiplex switching elements;

the switch control circuit may set the first switching element in an ON state and set the second switching element in an OFF state in a first divisional period within the first precharge period;

the switch control circuit may set the first switching element in an OFF state and set the second switching element in an ON state in a second divisional period after the first divisional period;

the switch control circuit may set the first switching element in an OFF state and set the second switching element in an ON state in a third divisional period within the second precharge period; and the switch control circuit may set the first switching element in an ON state and set the second switching element in an OFF state in a fourth divisional period after the third divisional period.

When a display panel having switching elements and others formed on a panel substrate by the low-temperature poly-silicon process is driven, the display driver enables to reduce power consumption accompanying charging/discharging of the data line by the polarity inversion drive and to prevent deterioration of the display quality.

In this display driver, the switch control circuit may include $2^K$ (K is a natural number) sets of registers, each of the sets including first to fourth divisional period setting registers; the switch control circuit may select one of the $2^K$ sets of register groups based on higher-order K bits of one of the first to third color component data obtained by time-dividing the display data in a horizontal scanning period which is immediately before a current horizontal scanning period; and the switch control circuit may control the first and second switching elements in each of the first to fourth divisional periods corresponding to values set in the first to fourth divisional period setting registers of the selected set.

This makes it possible to perform a strict precharge control for the data line of a display panel formed by the low-temperature poly-silicon process, and to simplify the precharge control.

In this display driver, the switch control circuit may control the first and second switching elements so that the first divisional period is longer than the second divisional period and the third divisional period is longer than the fourth divisional period.

Since the amount of electric charges consumed by charging/discharging of the data line can be reduced, power consumption can be further reduced.

According to one embodiment of the present invention, there is provided a display device comprising: a plurality of scanning lines; the data line; a plurality of pixels each of which is connected to one of the scanning lines and the data line; and any of the above display drivers which drive the data line.

According to one embodiment of the present invention, there is provided a display device comprising:

the scanning lines;

the data lines;

the pixels each of which is connected to one of the scanning lines and one of the data lines; and the demultiplexers each of which includes the first to third demultiplex switching elements exclusively controlled by the first to third demultiplex control signals, one end of each of the first to third demultiplex switching elements being connected to one of the data signal supply lines to which the time-divided drive voltages corresponding to the first to third color component data are supplied, and the other end of each of the first to third demultiplex switching elements being connected to one of the pixels for a jth color component ($1 \leqq j \leqq 3$, j is an integer); and any of the above display drivers.

This enables to provide a display device which can maintain an optimal display quality while reduced power consumption.

According to one embodiment of the present invention, there is provided a method of driving a data line of a display panel, the method comprising:

providing a first switching element connected between the data line and a first power supply line to which a first power supply voltage is supplied, and a second switching element connected between the data line and a second power supply line to which a second power supply voltage is supplied;

determining the lengths of a first divisional period and a second divisional period after the first divisional period within a first precharge period which is provided before a drive period in which a polarity of a drive voltage corresponding to display data is negative with respect to a reference potential, based on at least part of the display data in a horizontal scanning period which is immediately before a current horizontal scanning period;

setting the first switching element in an ON state and setting the second switching element in an OFF state in the first divisional period, and setting the first switching element in an OFF state and setting the second switching element in an ON state in the second divisional period; and setting the first and second switching elements in an OFF state after the first precharge period and driving the data line by using the drive voltage.

According to one embodiment of the present invention, there is provided a method of driving a plurality of data lines of a display panel, the display panel including: a plurality of scanning lines; the data lines; a plurality of pixels each of which is connected to one of the scanning lines and one of the data lines; and a plurality of demultiplexers each of which includes first to third demultiplex switching elements which are respectively and exclusively controlled by first to third demultiplex control signals, one end of each of the first to third demultiplex switching elements being connected to one of data signal supply lines to which time-divided drive voltages corresponding to first to third color component data are supplied, and the other end of each of the first to third demultiplex switching elements being connected to one of the pixels for a jth color component ($1 \leqq j \leqq 3$, j is an integer), the method comprising:

providing a first switching element connected between the data line and a first power supply line to which a first power supply voltage is supplied, and a second switching element connected between the data line and a second power supply line to which a second power supply voltage is supplied;

determining the lengths of a first divisional period and a second divisional period after the first divisional period within a first precharge period which is provided before a drive period in which a polarity of a drive voltage corresponding to display data is negative with respect to a reference potential, based on at least part of the first to third color component data of the display data in a horizontal scanning period which is immediately before a current horizontal scanning period, the first precharge period including a period in which each of the data signal supply lines is electrically connected to one of the data lines each of which is connected to one of the pixels for first to third color components by the first to third demultiplex switching elements;

setting the first switching element in an ON state and setting the second switching element in an OFF state in the first divisional period, and setting the first switching element in an OFF state and setting the second switching element in an ON state in the second divisional period; and setting the first and second switching elements in an OFF state after the first precharge period and driving the data lines by using the drive voltage.

In this drive method, the first divisional period may be longer than the second divisional period.

According to one embodiment of the present invention, there is provided a method of driving a data line of a display panel, the method comprising:

providing a first switching element connected between the data line and a first power supply line to which a first power supply voltage is supplied, and a second switching element connected between the data line and a second power supply line to which is supplied a second power supply voltage which is lower than the first power supply voltage; and determining the lengths of a third divisional period and a fourth divisional period after the third divisional period within a second precharge period which is provided before a drive period in which a polarity of a drive voltage corresponding to display data is positive with respect to a reference potential, based on at least part of the display data in a horizontal scanning period which is immediately before a current horizontal scanning period;

setting the first switching element in an OFF state and setting the second switching element in an ON state in the third divisional period, and setting the first switching element in an ON state and setting the second switching element in an OFF state in the fourth divisional period; and setting the first and second switching elements in an OFF state after the second precharge period and driving the data line by using the drive voltage.

According to one embodiment of the present invention, there is provided a method of driving a plurality of data lines of a display panel, the display panel including: a plurality of scanning lines; the data lines; a plurality of pixels each of which is connected to one of the scanning lines and one of the data lines; and a plurality of demultiplexers each of which includes first to third demultiplex switching elements which are respectively and exclusively controlled by first to third demultiplex control signals, one end of each of the first to third demultiplex switching elements being connected to one of data signal supply lines to which time-divided drive voltages corresponding to first to third color component data are supplied, and the other end of each of the first to third demultiplex switching elements being connected to one of the pixels for a jth color component ($1 \leqq j \leqq 3$, j is an integer), the method comprising:

providing a first switching element connected between the data line and a first power supply line to which a first power supply voltage is supplied, and a second switching element connected between the data line and a second power supply line to which a second power supply voltage is supplied;

determining the lengths of a third divisional period and a fourth divisional period after the third divisional period within a second precharge period which is provided before a drive period in which a polarity of a drive voltage corresponding to display data is positive with respect to a reference potential, based on at least part of the first to third color component data of the display data in a horizontal scanning period which is immediately before a current horizontal scanning period, the second precharge period including a period in which each of the data signal supply lines is electrically connected to one of the data lines each of which is connected to one of the pixels for first to third color components by the first to third demultiplex switching elements;

setting the first switching element in an OFF state and setting the second switching element in an ON state in the third divisional period, and setting the first switching element in an ON state and setting the second switching element in an OFF state in the fourth divisional period; and setting the first and second switching elements in an OFF state after the second precharge period and driving the data lines by using the drive voltage.

In this drive method, the third divisional period may be longer than the fourth divisional period.

These embodiments of the present invention are described below in detail with reference to the drawings.

1. Display Device

FIG. 1 schematically shows configuration of a display device including the display driver according to one embodiment of the present invention.

A display device 10 (electro-optical device or liquid crystal device in a narrow sense) may include a display panel 20 (liquid crystal panel in a narrow sense).

The display panel 20 is formed on a glass substrate, for example. A plurality of scanning lines (gate lines) GL1 to GLM (M is an integer of two or more), arranged in the Y direction and extending in the X direction, and a plurality of data lines (source lines) DL1 to DLN (N is an integer of two or more), arranged in the X direction and extending in the Y direction, are disposed on the glass substrate. A pixel region (pixel) is provided corresponding to the intersecting point of the scanning line GLm ($1 \leqq m \leqq M$, m is an integer; hereinafter the same) and the data line DLn ($1 \leqq n \leqq N$, n is an integer; hereinafter the same). A thin film transistor 22nm (hereinafter abbreviated as "TFT") is disposed in the pixel region.

A gate electrode of the TFT 22mn is connected with the scanning line GLn. A source electrode of the TFT 22mn is connected with the data line DLn. A drain electrode of the TFT 22mn is connected with the pixel electrode 26mn. A liquid crystal is sealed between the pixel electrode 26mn and a common electrode 28mn which faces the pixel electrode 26mn, whereby a liquid crystal capacitor 24mn (liquid crystal element in a broad sense) is formed. The transmittance of the pixel changes corresponding to the voltage applied between the pixel electrode 26mn and the common electrode 28mn . A common electrode voltage Vcom is supplied to the common electrode 28mn.

The display device 10 may include a display driver 30 (data driver in a narrow sense). The display driver 30 drives the data lines DL1 to DLN of the display panel 20 based on display data.

The display device 10 may include a gate driver 32. The gate driver 32 scans the scanning lines GL1 to GLM of the display panel 20 within one vertical scanning period.

The display device 10 may include a power supply circuit 34. The power supply circuit 34 generates voltages necessary for driving the data lines, and supplies the voltages to the display driver 30. In this embodiment, the power supply circuit 34 generates power supply voltages VDDH and VSSH necessary for driving the data lines of the display driver 30 and voltages for the logic section of the display driver 30.

The power supply circuit 34 generates voltages necessary for scanning the scanning lines, and supplies the voltages to the gate driver 32. In this embodiment, the power supply circuit 34 generates drive voltages for scanning the scanning lines.

The power supply circuit 34 may generate the common electrode voltage Vcom. The power supply circuit 34 outputs the common electrode voltage Vcom, which is repeatedly set at a high-potential-side voltage VcomH and a low-potential-side voltage VcomL in synchronization with the timing of a polarity inversion signal POL generated by the display driver 30, to the common electrode of the display panel 20.

The display device 10 may include a display controller 38. The display controller 38 controls the display driver 30, the gate driver 32, and the power supply circuit 34 according to the contents set by a host such as a central processing unit (hereinafter abbreviated as "CPU") (not shown). The display controller 38 provides an operation mode setting and a vertical synchronization signal or a horizontal synchronization signal generated therein to the display driver 30 and the gate driver 32, for example.

In FIG. 1, the display device 10 includes the power supply circuit 34 and the display controller 38. However, at least one of the power supply circuit 34 and the display controller 38 may be provided outside the display device 10. The display device 10 may include the host.

The display driver 30 may include at least one of the gate driver 32 and the power supply circuit 34.

Figure 2:
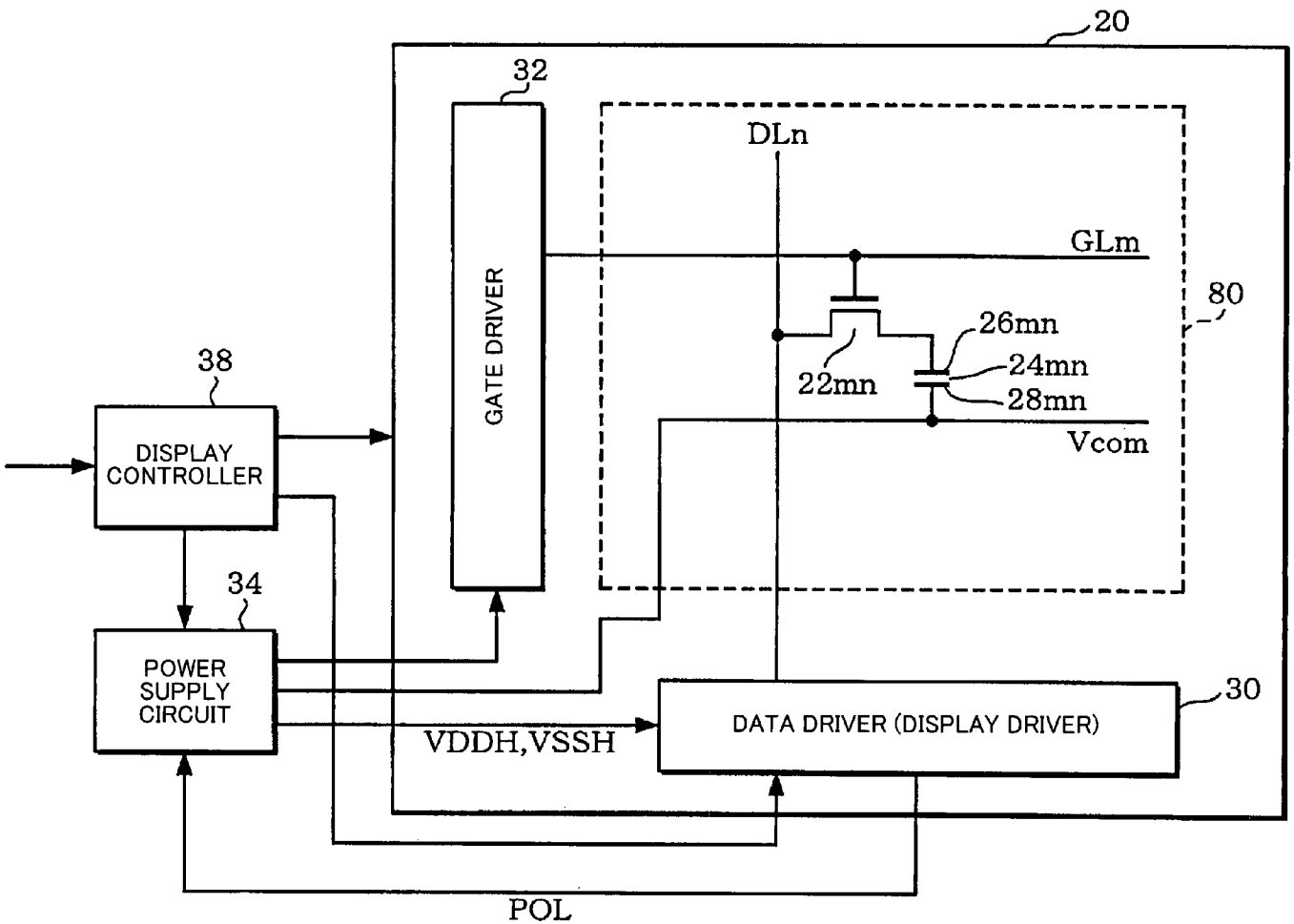
FIG. 2 is a block diagram schematically showing another configuration of a display device including the display driver according to one embodiment of the present invention.

At least one of the display driver 30, the gate driver 32, the display controller 38, and the power supply circuit 34 may be formed on the display panel 20, for example. In FIG. 2, the display driver 30 and the gate driver 32 are formed on the display panel 20. As described above, the display panel 20 may be configured to include a plurality of data lines, a plurality of scanning lines, a plurality of pixels, each of the pixels being connected with one of the scanning lines and one of the data lines, and a display driver which drives the data lines. A plurality of pixels are formed in a pixel formation region 80 of the display panel 20.

2. Display Driver

Figure 3:
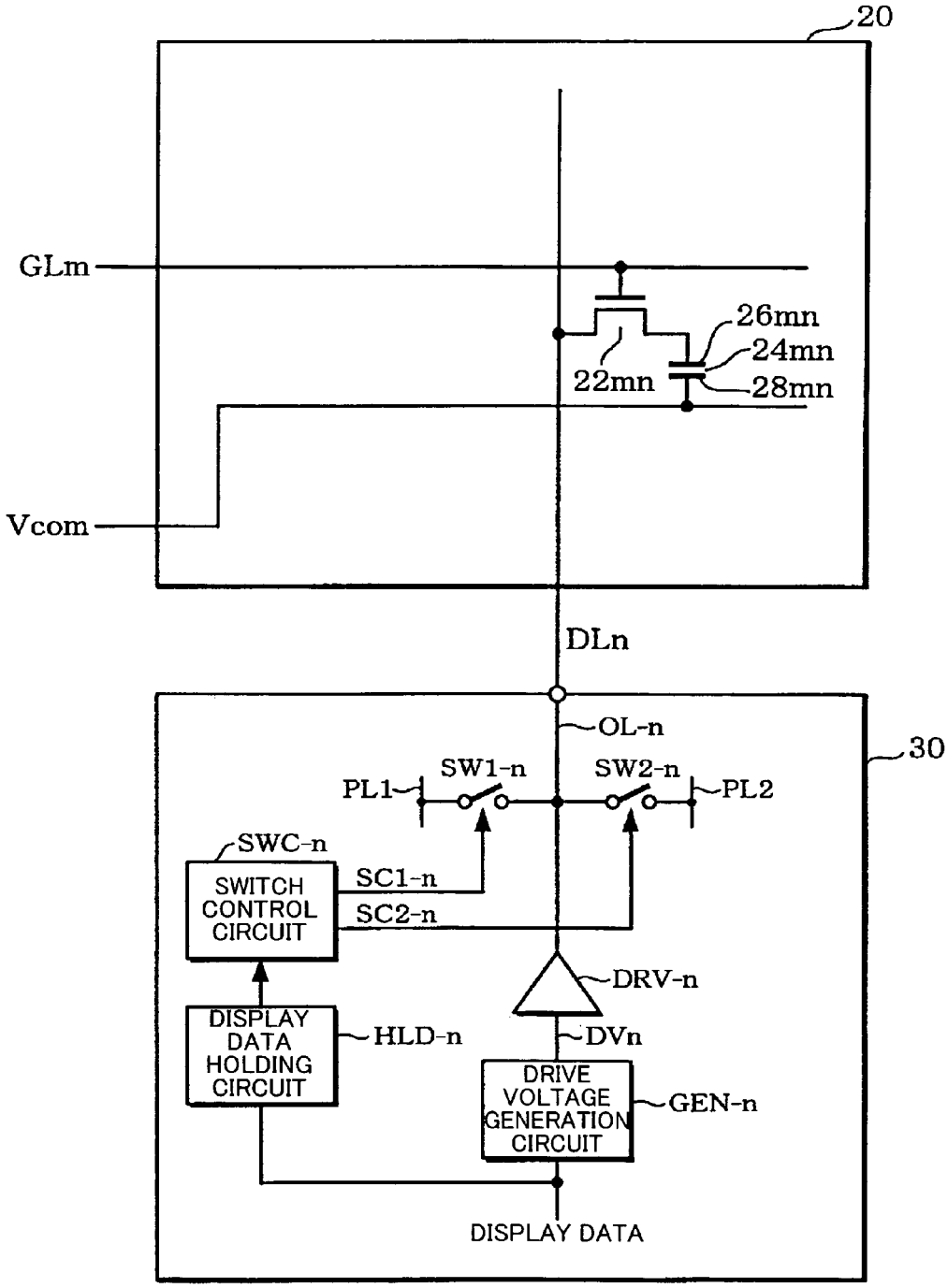
FIG. 3 is a diagram showing main components of a display driver according to one embodiment of the present invention.

FIG. 3 shows main components of the display driver according to one embodiment of the present invention. Note that components corresponding to those in FIG. 1 or 2 are denoted by the same reference numbers and further description thereof is omitted.

The display driver 30 drives the data lines DL1 to DLN based on the display data. The display data corresponds to one data line.

The display driver 30 includes data line driver circuits DRV-1 to DRV-N, first switching elements SW1-1 to SW1-N, second switching elements SW2-1 to SW2-N, and switch control circuits SWC-1 to SWC-N. The first switching elements SW1-1 to SW1-N and the second switching elements SW2-1 to SW2-N are formed by MOS transistors.

FIG. 3 illustrates only an essential portion of the configuration relating to the data line driver circuit DRV-n which drives the data line DLn ($1 \leqq n \leqq N$, n is an integer).

The output of the data line driver circuit DRV-n is connected with an output line OL-n. The output line OL-n is connected with the data line DLn of the display panel 20. The data line driver circuit DRV-n outputs a drive voltage DVn corresponding to the display data to the output line OL-n.

The drive voltage DVn is generated by a drive voltage generation circuit GEN-n. The drive voltage generation circuit GEN-n generates the drive voltage DVn based on the display data corresponding to the data line DLn.

The first switching element SW1-n is connected between a first power supply line PL1 to which a first power supply voltage PV1 is supplied and the output line OL-n. The first switching element SW1-n is ON-OFF controlled by a first switch control signal SC1. The first power supply line PL1 is electrically connected with the output line OL-n when the first switching element SW1-n is in an ON state. The first power supply line PL1 is electrically disconnected from the output line OL-n when the first switching element SW1-n is in an OFF state.

The second switching element SW2-n is connected between a second power supply line PL2 to which a second power supply voltage PV2 is supplied and the output line OL-n. The second switching element SW2-n is ON-OFF controlled by a second switch control signal SC2. The second power supply line PL2 is electrically connected with the output line OL-n when the second switching element SW2-n is in an ON state. The second power supply line PL2 is electrically disconnected from the output line OL-n when the second switching element SW2-n is in an OFF state.

The switch control circuit SWC-n controls the first and second switching elements SW1-n and SW2-n. Specifically, each of the switch control circuits SWC-1 to SWC-N is provided corresponding to one data line.

The switch control circuit SWC-n generates the first and second control signals SC1-n and SC2-n. In more detail, the switch control circuit SWC-n generates the first and second control signals SC1-n and SC2-n based on at least part of the display data in the horizontal scanning period immediately before the current horizontal scanning period. In more detail, the switch control circuit SWC-n generates the first and second control signals SC1-n and SC2-n based on at least part of the display data supplied corresponding to the data line DLn in the horizontal scanning period immediately before the current horizontal scanning period.

The current horizontal scanning period means the period in which the data line driver circuit DRV-n drives the data line precharged using the first and second switch control signals SC1-n and SC2-n. The display data in the horizontal scanning period immediately before the current horizontal scanning period is the display data supplied one horizontal scanning period before the display data used in the current horizontal scanning period.

The switch control circuit SWC-n controls the first switching element SW1-n by using the first switch control signal SC1-n, and controls the second switching element SW2-n by using the second switch control signal SC2-n.

In FIG. 3, the display driver 30 includes a display data holding circuit HLD-n. The display data holding circuit HLD-n holds at least part of the display data supplied corresponding to the data line DLn in the horizontal scanning period immediately before the current horizontal scanning period. The switch control circuit SWC-n generates the first and second switch control signals SC1-n and SC2-n based on at least part of the display data held by the display data holding circuit HLD-n in order to use the first and second switch control signals SC1-n and SC2-n in the current horizontal scanning period (present horizontal scanning period).

The display driver 30 may have a configuration in which the display data holding circuit HLD-n is omitted. In this case, the display driver 30 may hold data for generating the first and second switch control signals SC1-n and SC2-n in the current horizontal scanning period based on at least part of the display data supplied corresponding to the data line DLn in the horizontal scanning period immediately before the current horizontal scanning period. This enables the switch control circuit SWC-n to use the first and second switch control signals SC1-n and SC2-n generated based on at least part of the display data supplied corresponding to the data line DLn in the horizontal scanning period immediately before the current horizontal scanning period in the current horizontal scanning period.

Figure 4:
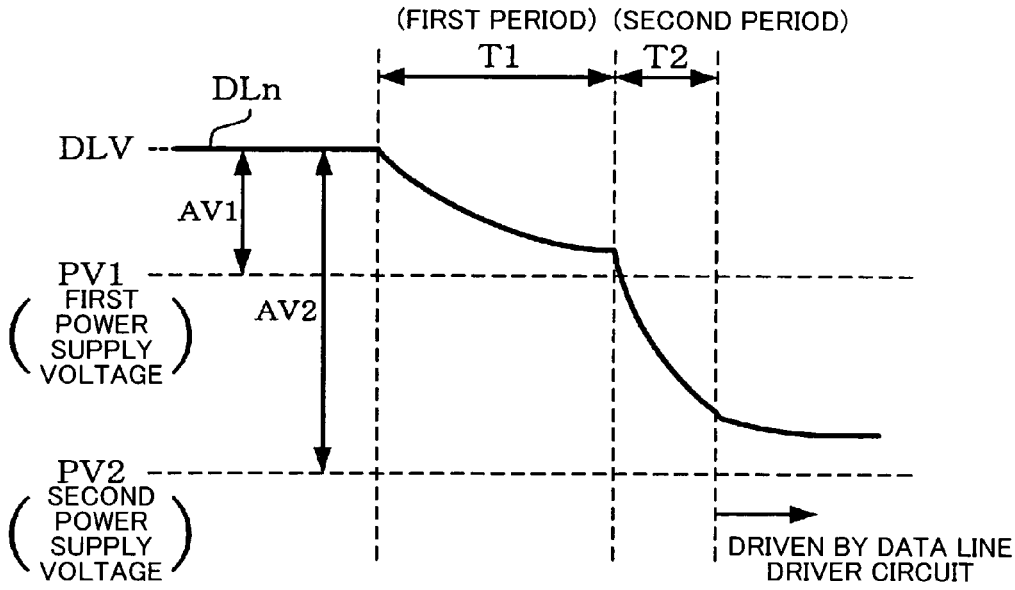
FIG. 4 is a diagram schematically showing an example of potential change of a data line driven by the display driver according to one embodiment of the present invention.

FIG. 4 schematically shows an example of potential change of a data line driven by the display driver 30. Although FIG. 4 shows the potential change of the data line DLn, the same description also applies to other data lines.

The display driver 30 (switch control circuit SWC-n in more detail) electrically connects the output line OL-n with the first power supply line PL1 in a first period T1 by setting the first switching element SW1-n in an ON state and setting the second switching element SW2-n in an OFF state. Therefore, the output line OL-n (output lines OL-1 to OL-N) is electrically disconnected from the second power supply line PL2. This causes the potential of the data line DLn to approach the first power supply voltage PV1 of the first power supply line PL1 in the first period T1.

The display driver 30 electrically connects the output line OL-n with the second power supply line PL2 in a second period T2 after the first period T1 by setting the first switching element SW1-n in an OFF state and setting the second switching element SW2-n in an ON state. Therefore, the output line OL-n (output lines OL-1 to OL-N) is electrically disconnected from the first power supply line PL1. This causes the potential of the data line DLn to approach the second power supply voltage PV2 of the second power supply line PL2 in the second period T2.

The display driver 30 sets the first and second switching elements SW1-n and SW2-n in an OFF state after the second period T2, and drives the output line OL-n by the data line driver circuit DRV-n. Therefore, the output line OL-n (output lines OL-1 to OL-N) is electrically disconnected from the first and second power supply lines PL1 and PL2. This causes the voltage corresponding to the display data to be supplied to the data line DLn after the second period T2.

In FIG. 4, the second period T2 is provided immediately after the first period T1. However, the second period T2 may be provided when a given period of time has elapsed after the first period T1.

As described above, the data lines DL1 to DLN are precharged in each of the first and second periods T1 and T2 before driving the data lines DL1 to DLN by the data line driver circuits DRV-1 to DRV-N. The voltage corresponding to the display data is supplied to the data lines DL1 to DLN after the second period T2.

This reduces the charge/discharge time of the data line by using the precharge technology, whereby deterioration of the display quality can be prevented. In this embodiment, since the configuration in which the data line is precharged in two stages is employed, in the case where the second power supply voltage is a system ground power supply voltage, the amount of positive charges flowing from the data line into the system ground power supply line can be minimized during charging/discharging of the data line. Specifically, a precharge method in which the data line is merely connected with the potential provided in advance causes electric charges to flow into the system ground power supply line during charging/discharging of the data line, whereby power consumption is increased. However, according to this embodiment, since the amount of electric charges flowing into the system ground power supply line can be minimized, power consumption can be reduced.

In this embodiment, it is preferable that the absolute value AV1 of the difference between the voltage DLV of the data line when the first period T1 is started and the first power supply voltage PV1 be smaller than the absolute value AV2 of the difference between the voltage DLV of the data line when the first period T1 is started and the second power supply voltage PV2, as shown in FIG. 4.

Specifically, in the case of driving the data line at a low potential, the data line is precharged to a higher potential and is then precharged to a lower potential. Therefore, since the period in which positive charges flow toward a lower potential can be reduced, power consumption can be reduced by reutilizing electric charges due to precharging to a higher potential. Moreover, since the data line is precharged to a lower potential before the data line is driven based on the display data, an accurate voltage can be supplied to the data line even if the precharge cycle is reduced, whereby it is possible to deal with an increase in the display size and to prevent deterioration of the display quality.

In the case of driving the data line at a high potential, the data line is precharged to a lower potential and is then precharged to a higher potential. Therefore, since the period in which negative charges flow toward a higher potential can be reduced, power consumption can be reduced by reutilizing electric charges due to precharging to a lower potential. Moreover, since the data line is precharged to a higher potential before the data line is driven based on the display data, an accurate voltage can be supplied to the data line even if the precharge cycle is reduced.

It is preferable that the switch control circuit SWC-n switch-control so that the first period T1 is longer than the second period T2. Since the amount of electric charges consumed by charging/discharging of the data line can be reduced as described above, power consumption can be further reduced.

The display driver 30 may determine the length of the first and second periods T1 and T2 based on at least part of the display data in the horizontal scanning period immediately before the current horizontal scanning period.

Figure 5A:
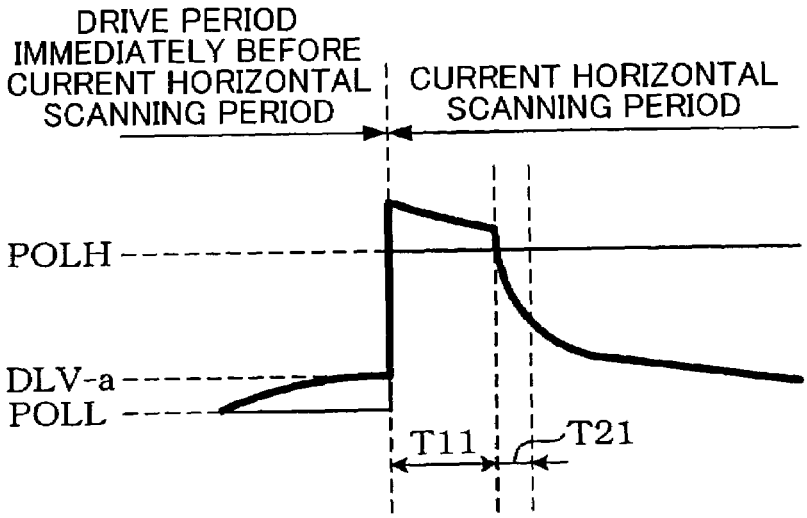
FIGS. 5A and 5B are diagrams for illustrating switch control of first and second switching elements based on at least part of display data in a horizontal scanning period immediately before a current horizontal scanning period.
Figure 5B:
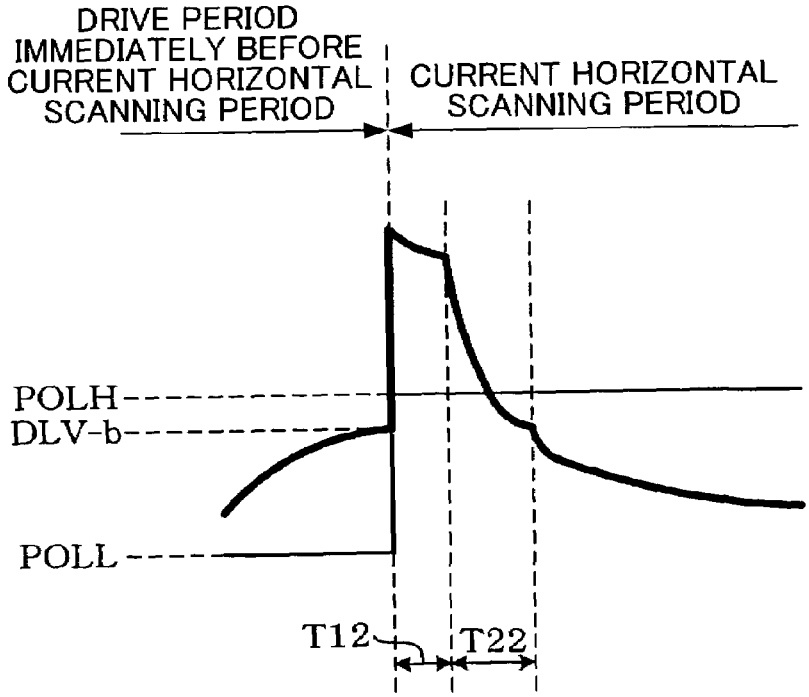

FIGS. 5A and 5B are diagrams for illustrating switch control of first and second switching elements by the display driver 30 based on at least part of display data in a horizontal scanning period immediately before a current horizontal scanning period.

The display driver 30 performs the polarity inversion drive which reverses the polarity of the voltage applied to the liquid crystal in order to prevent deterioration of the liquid crystal. The polarity inversion drive reverses the voltage applied to the liquid crystal at timing specified by the polarity inversion signal POL. The polarity inversion signal POL periodically changes corresponding to the cycle of frame reversal drive or line reversal drive. FIGS. 5A and 5B schematically show only the period in which the logical level of the polarity inversion signal POL changes from L to H.

The common electrode voltage Vcom changes in synchronization with the polarity inversion signal POL. The common electrode voltage Vcom is set at the high-potential-side voltage VcomH when the polarity inversion signal POL is set at a high-potential-side voltage POLH. The common electrode voltage Vcom is set at the low-potential-side voltage VcomL when the polarity inversion signal POL is set at a low-potential-side voltage POLL.

The display driver 30 which performs such a polarity inversion drive controls the first and second switching elements as described above in each of the first and second periods T1 and T2 determined based on at least part of the display data in the horizontal scanning period immediately before the current horizontal scanning period.

In more detail, as shown in FIG. 5A, when the voltage of the data line DLn driven based on the display data in the horizontal scanning period immediately before the current horizontal scanning period is a voltage DLV-a, the switch control circuit SWC-n controls the first and second switching elements SW1-n and SW2-n so that first and second periods T11 and T12 occur in the current horizontal scanning period. The data line DLn is precharged in the first period T11 in the same manner as in the first period T1. The data line DLn is precharged in the second period T12 in the same manner as in the second period T2.

As shown in FIG. 5B, when the voltage of the data line DLn driven based on the display data in the horizontal scanning period immediately before the current horizontal scanning period is a voltage DLV-b, the switch control circuit SWC-n controls the first and second switching elements SW1-n and SW2-n so that first and second periods T12 and T22 occur in the current horizontal scanning period. The data line DLn is precharged in the first period T12 in the same manner as in the first period T1. The data line DLn is precharged in the second period T22 in the same manner as in the second period T2.

As described above, the switch control circuit SWC-n (display driver 30) changes the lengths of the first and second periods in the current horizontal scanning period corresponding to the display data in the horizontal scanning period immediately before the current horizontal scanning period.

In the case where the display panel 20 is in a normally white mode, the switch control circuit SWC-n (display driver 30) decreases the length of the first period and increases the length of the second period in the current horizontal scanning period as the gray-scale value represented by the display data in the horizontal scanning period immediately before the current horizontal scanning period is greater. As the gray-scale value represented by the display data in the horizontal scanning period immediately before the current horizontal scanning period is greater, it is necessary to change the potential to a greater extent in the current horizontal scanning period in which the polarity is reversed. The control circuit SWC-n increases the length of the first period and decreases the length of the second period in the current horizontal scanning period as the gray-scale value represented by the display data in the horizontal scanning period immediately before the current horizontal scanning period is smaller. FIGS. 5A and 5B show the case where the display panel 20 is in the normally white mode.

In the case where the display panel 20 is in a normally black mode, the switch control circuit SWC-n (display driver 30) increases the length of the first period and decreases the length of the second period in the current horizontal scanning period as the gray-scale value represented by the display data in the horizontal scanning period immediately before the current horizontal scanning period is greater. The control circuit SWC-n decreases the length of the first period and increases the length of the second period in the current horizontal scanning period as the gray-scale value represented by the display data in the horizontal scanning period immediately before the current horizontal scanning period is smaller.

The advantages obtained by controlling the lengths of the first and second periods are described below taking the case of realizing the polarity inversion drive as an example.

Figure 6:
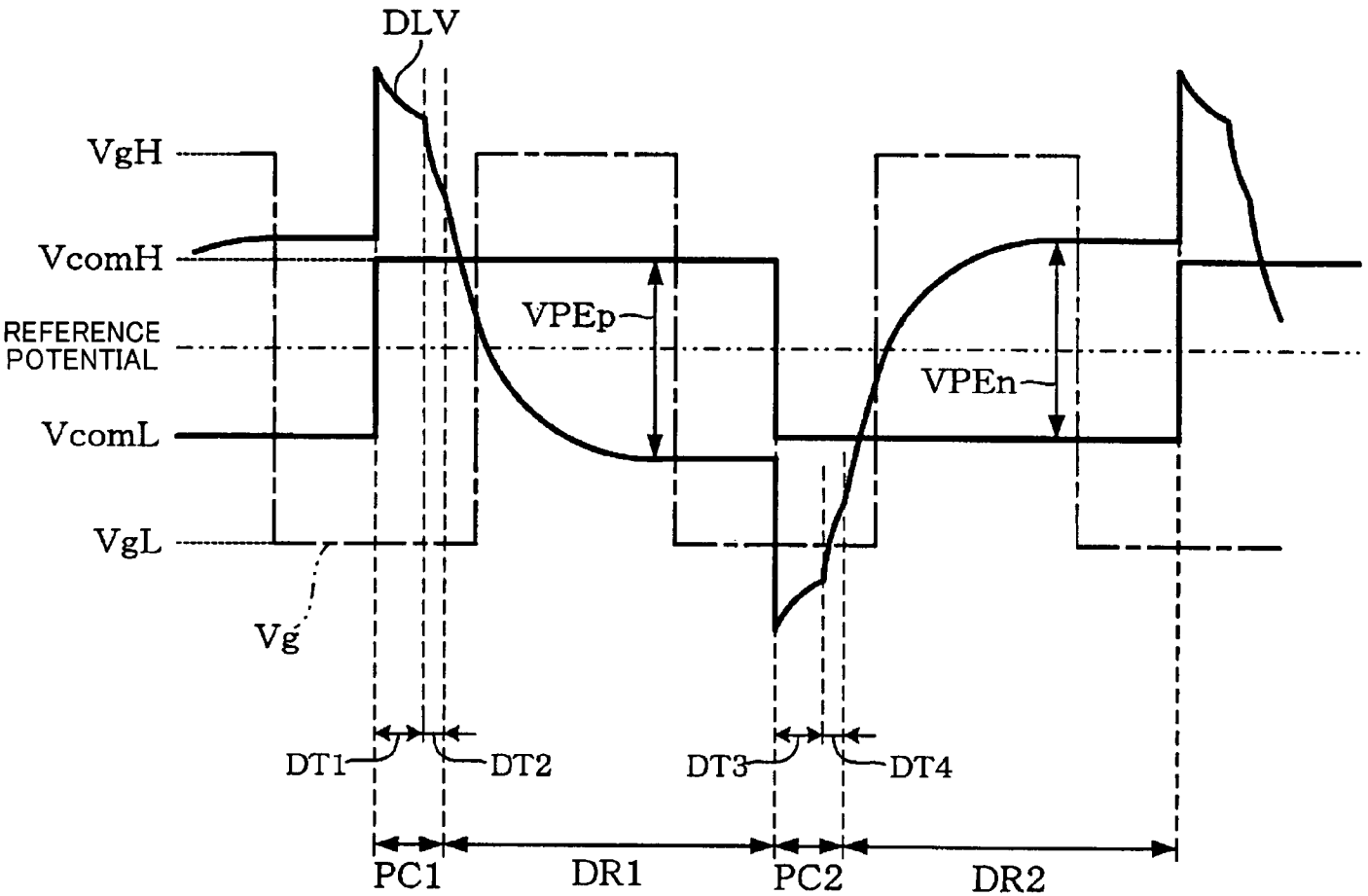
FIG. 6 is a diagram schematically showing an example of potential change of a data line when the polarity inversion is implemented by the display driver according to one embodiment of the present invention.

FIG. 6 schematically shows an example of potential change of a data line when the polarity inversion is implemented by the display driver 30. Although FIG. 6 shows the potential change of the data line DLn, the same description also applies to other data lines.

In FIG. 6, when the polarity inversion signal POL is set at the high-potential-side voltage POLH, the drive voltage driven by the data line driver circuit DRV-n shown in FIG. 3 becomes negative with respect to the potential of the common electrode voltage Vcom (given reference potential). In FIG. 6, when the polarity inversion signal POL is set at the low-potential-side voltage POLL, the drive voltage driven by the data line driver circuit DRV-n shown in FIG. 3 becomes positive with respect to the potential of the common electrode voltage Vcom (given reference potential).

A gate voltage Vg shown in FIG. 6 is supplied to the scanning line GLm in the drive period. When the scanning lines GL1 to GLM are scanned and the scanning line GLm is selected, the gate voltage Vg changes from a low-potential-side gate voltage VgL to a high-potential-side gate voltage VgH. When the gate voltage Vg is set at the high-potential-side gate voltage VgH, the data line DLn is electrically connected with the pixel electrode 26mn through the TFT22 connected with the scanning line GLm. Specifically, the data line DLn and the pixel electrode 26mn are set at approximately the same potential. The transmittance of the pixel changes corresponding to the voltage applied between the pixel electrode 26mn and the common electrode 28mn. In FIG. 6, a voltage VPEp in a drive period DR1 and a voltage VPEn in a drive period DR2 correspond to the voltage applied between the pixel electrode 26mn and the common electrode 28mn.

It is preferable that the potential of the first power supply voltage PV1 be higher than the potential of the second power supply voltage PV2. As the first power supply voltage PV1, the high-potential-side power supply voltage of the data line driver circuit DRV-n (data line driver circuits DRV-1 to DRV-N) may be used, for example. As the second power supply voltage PV2, the low-potential-side power supply voltage of the data line driver circuit DRV-n (data line driver circuits DRV-1 to DRV-N) may be used, for example.

In a first precharge period PC1 provided before the drive period in which the polarity is negative and a second precharge period PC2 provided before the drive period in which the polarity is positive, the display driver 30 in this embodiment performs the above-described precharge operation in divisional periods into which each precharge period is divided.

Specifically, the first precharge period PC1 includes first and second divisional periods DT1 and DT2. The second divisional period DT2 may be provided when a given period has elapsed after the first divisional period DT1. The first precharge period PC1 may be longer than the sum of the first and second divisional periods DT1 and DT2.

Figure 7:
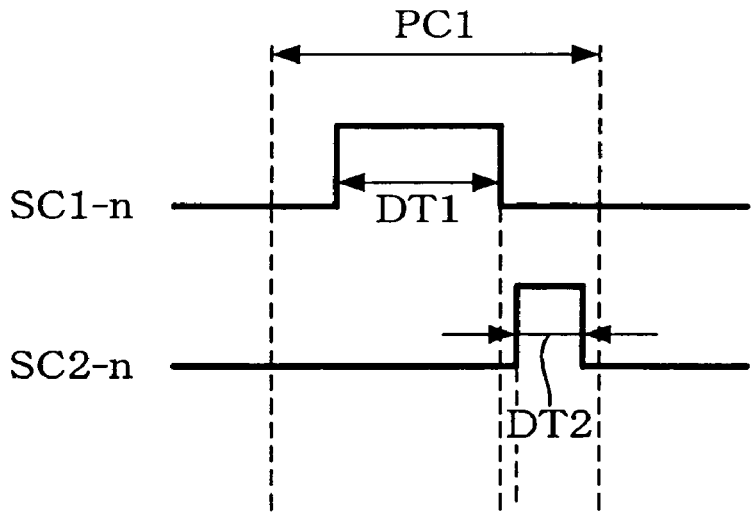
FIG. 7 is a timing chart of the first and second switch control signals in a first precharge period.

FIG. 7 is a timing chart of the first and second switch control signals SC1-n and SC2-n in the first precharge period PC1.

The first switch control signal SC1-n generated by the switch control circuit SWC-n is input to the first switching element SW1-n. The first switching element SW1-n is ON-OFF controlled based on the first switch control signal SC1-n. The first switching element SW1-n is turned ON when the first switch control signal SC1-n is set at a logical level H. The first switching element SW1-n is turned OFF when the first switch control signal SC1-n is set at a logical level L. Therefore, the period in which the first switch control signal SC1-n is set at a logical level H corresponds to the first divisional period DT1.

The second switch control signal SC2-n generated by the switch control circuit SWC-n is input to the second switching element SW2. The second switching element SW2-n is ON-OFF controlled based on the second switch control signal SC-n. The second switching element SW2-n is turned ON when the second switch control signal SC2-n is set at a logical level H. The second switching element SW2-n is turned OFF when the second switch control signal SC2-n is set at a logical level L. Therefore, the period in which the second switch control signal SC2-n is set at a logical level H corresponds to the second divisional period DT2.

In this embodiment, the first divisional period DT1 and the second divisional period DT2 after the first divisional period DT1 are set in the first precharge period PC1 by the first and second switch control signals SC1-n and SC-n.

The switch control circuit SWC-n sets the first switching element SW1-n in an ON state and sets the second switching element SW2-n in an OFF state in the first divisional period DT1 in the first precharge period PC1. Specifically, the same state as in the first period T1 shown in FIG. 4 is created.

The common electrode voltage Vcom is set at the high-potential-side common electrode voltage VcomH in the drive period in which the polarity of the liquid crystal reversal drive is negative. This causes the voltage of the data line DLn to be relatively increased with respect to the common electrode voltage Vcom. This increases the difference between the voltage of the data line DLn and the voltage which should be supplied to the data line DLn in the drive period in which the polarity of the liquid crystal reversal drive is negative, whereby the period of time necessary for the voltage of the data line DLn to reach the voltage which should be supplied to the data line DLn is increased. Therefore, the data line DLn is precharged in the first divisional period DT1 by connecting the data line DLn with the high-potential-side first power supply voltage PV1. This causes electric charges (positive charges) from the data line to flow into the first power supply line PL1 to which the first power supply voltage PV1 is supplied. This enables electric charges to be reutilized, whereby power consumption can be reduced.

The switch control circuit SWC-n sets the first switching element SW1-n in an OFF state and sets the second switching element SW2-n in an ON state in the second divisional period DT2 after the first divisional period DT1. Specifically, the same state as in the second period T2 shown in FIG. 4 is created.

In the second divisional period DT2, the data line DLn is precharged by connecting the data line DLn with the low-potential-side second power supply voltage PV2. This causes electric charges from the data line to flow into the second power supply line PL2 to which the second power supply voltage PV2 is supplied, whereby power consumption is increased. However, the voltage of the data line DLn can be promptly set at or near a desired voltage.

In the first drive period DR1 after the second divisional period DT2 (after the first precharge period PC1), the data line DLn is driven by the data line driver circuit DRV-n based on the drive voltage corresponding to the display data. In this case, since it suffices that the data line be charged or discharged from the voltage set in the second divisional period DT2, the amount of charging/discharging of the data line accompanying supply of the drive voltage based on the display data can be reduced.

In this embodiment, it is preferable that the first divisional period DT1 be longer than the second divisional period DT2. This reduces the period in which electric charges from the data line flow into the second power supply line PL2 to which the second power supply voltage PV2 is supplied, whereby power consumption can be reduced.

The second precharge period PC2 includes third and fourth divisional periods DT3 and DT4 . The fourth divisional period DT4 may be provided when a given period has elapsed after the third divisional period DT3 . The second precharge period PC2 may be longer than the sum of the third and fourth divisional periods DT3 and DT4.

Figure 8:
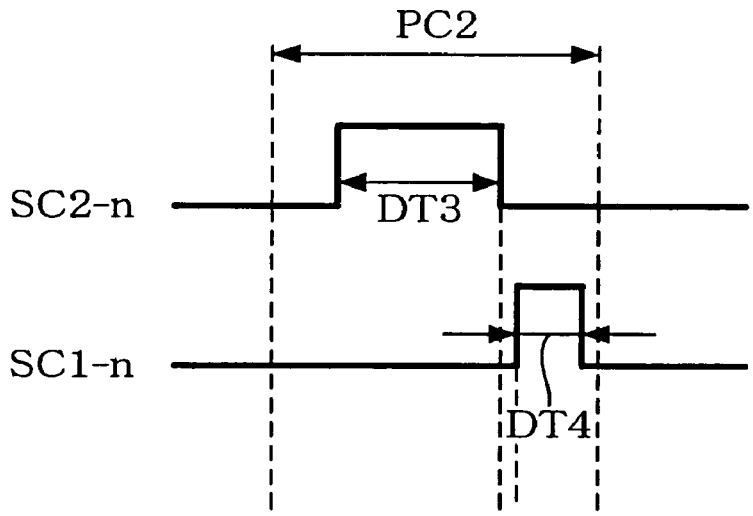
FIG. 8 is a timing chart of the first and second switch control signals in a second precharge period.

FIG. 8 is a timing chart of the first and second switch control signals SC1-n and SC2-n in the second precharge period PC2.

In the second precharge period PC2, the period in which the second switch control signal SC2-n is set at a logical level H corresponds to the third divisional period DT3 . In the second precharge period PC2, the period in which the first switch control signal SC1-n is set at a logical level H corresponds to the fourth divisional period DT4.

In this embodiment, the third divisional period DT3 and the fourth divisional period DT4 after the third divisional period DT3 are set in the second precharge period PC2 by the first and second switch control signals SC1-n and SC-n.

The switch control circuit SWC-n sets the first switching element SW1-n in an OFF state and sets the second switching element SW2-n in an ON state in the third divisional period DT3 in the second precharge period PC2. Specifically, the same state as in the first period T1 shown in FIG. 4 is created.

The common electrode voltage Vcom is set at the low-potential-side common electrode voltage VcomL in the drive period in which the polarity of the liquid crystal reversal drive is positive. This causes the voltage of the data line DLn to be relatively decreased with respect to the common electrode voltage Vcom. This increases the difference between the voltage of the data line DLn and the voltage which should be supplied to the data line DLn in the drive period in which the polarity of the liquid crystal reversal drive is positive, whereby the period of time necessary for the voltage of the data line DLn to reach the voltage which should be supplied to the data line DLn is increased. Therefore, in the third divisional period DT3 , the data line DLn is precharged by connecting the data line DLn with the low-potential-side second power supply voltage PV2. This causes electric charges (negative charges) from the data line to flow into the second power supply line PL2 to which the second power supply voltage PV2 is supplied. This enables electric charges to be reutilized, whereby power consumption can be reduced.

In the fourth divisional period DT4 after the third divisional period DT3 , the switch control circuit SWC-n sets the first switching element SW1-n in an ON state and sets the second switching element SW2-n in an OFF state. Specifically, the same state as in the second period T2 shown in FIG. 4 is created.

In the fourth divisional period DT4 , the data line DLn is precharged by connecting the data line DLn with the high-potential-side first power supply voltage PV1. This causes electric charges from the data line to flow into the second power supply line PL2 to which the second power supply voltage PV2 is supplied, whereby power consumption is increased. However, the voltage of the data line DLn can be promptly set at or near a desired voltageata. This reduces the amount of charging/discharging of the data line accompanying supply of the drive voltage based on the display data.

In the second drive period DR2after the fourth divisional period DT4 (after the second precharge period PC2), the data line DLn is driven by the data line driver circuit DRV-n based on the drive voltage corresponding to the display data. In this case, since it suffices that the data line be charged or discharged from the voltage set in the fourth divisional period DT4 , the amount of charging/discharging of the data line accompanying supply of the drive voltage based on the display data can be reduced.

In this embodiment, it is preferable that the third divisional period DT3 be longer than the fourth divisional period DT4 . This reduces the period in which electric charges from the data line flow into the first power supply line PL1 to which the first power supply voltage PV1 is supplied, whereby power consumption can be reduced.

In this embodiment, the lengths of the first to fourth divisional periods DT1 to DT4 are changed based on at least part of the display data in the horizontal scanning period immediately before the current horizontal scanning period, as described with reference to FIG. 5. The first and third divisional periods DT1 and DT3 (first period T1) are increased when the potential of the data line DLn is changed to a small extent by the polarity inversion drive, whereby power consumption can be reduced. The second and fourth divisional periods DT2 and DT4 (second period T2) are increased when the potential of the data line DLn is changed to a large extent by the polarity inversion drive, whereby the data line DLn is caused to promptly reach a desired potential. This prevents deterioration of the display quality. A display driver which improves the display quality and reduces power consumption can be provided by performing such a strict precharge control.

In FIG. 6, the first and second precharge periods PC1 and PC2 are started at the change point of the common electrode voltage Vcom. However, the present invention is not limited thereto. The first and second precharge periods PC1 and PC2 may be started before the change point of the common electrode voltage Vcom.

Figure 9:
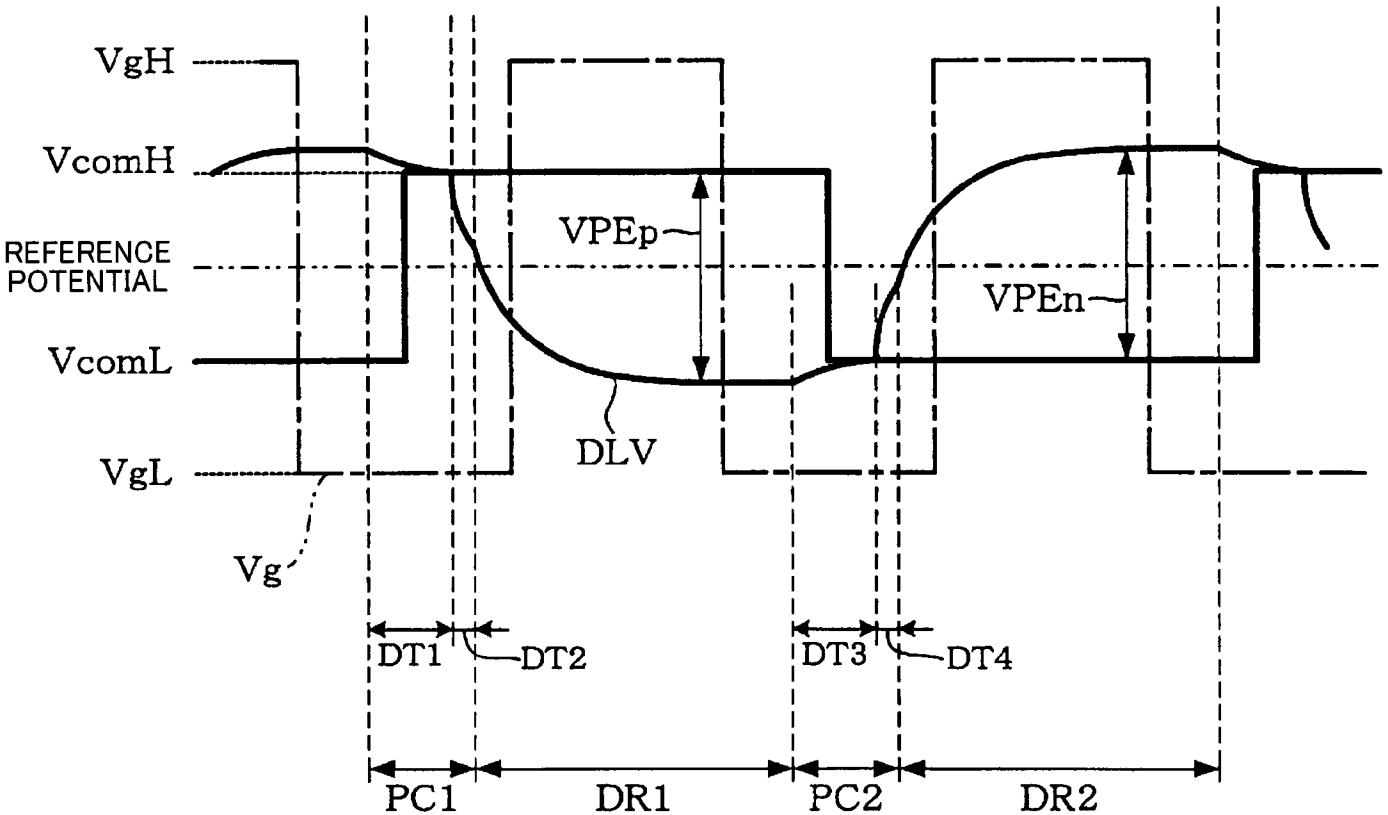
FIG. 9 is a diagram schematically showing another example of potential change of a data line when the polarity inversion is implemented by the display driver according to one embodiment of the present invention.

FIG. 9 is a diagram schematically showing another example of potential change of a data line when the polarity inversion is implemented by the display driver 30. Although FIG. 9 shows the potential change of the data line DLn, the same description also applies to other data lines.

In this case, the first divisional period DT1 in the first precharge period PC1 and the third divisional period DT3 in the second precharge period PC2 can be increased in comparison with the case shown in FIG. 6. Therefore, the second divisional period DT2 in the first precharge period PC1 and the fourth divisional period DT4 in the second precharge period PC2 can be reduced to that extent. This increases the period in which electric charges are reutilized and reduces the period in which electric charges are not reutilized, whereby power consumption can be further reduced.

3. Configuration of Display Driver

Figure 10:
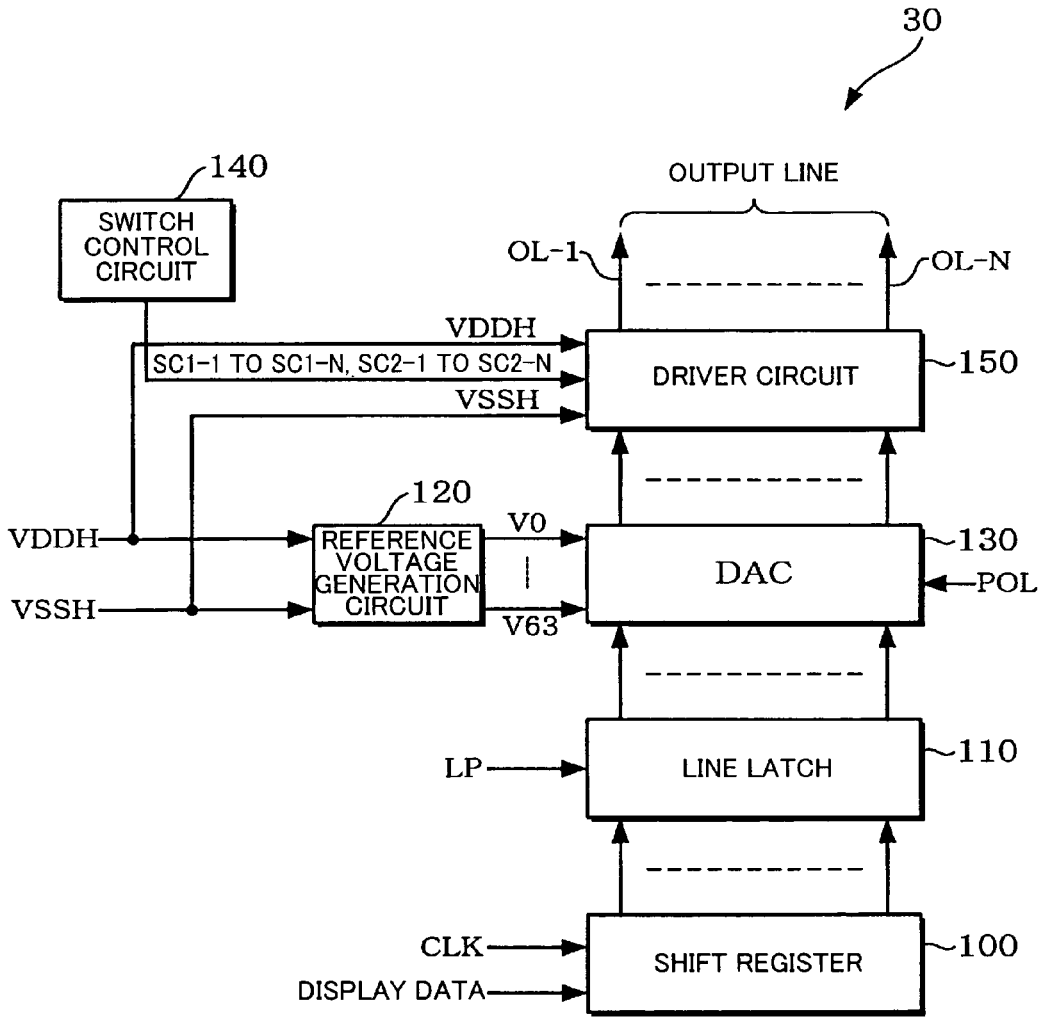
FIG. 10 is a block diagram showing configuration of a display device according to one embodiment of the present invention.

FIG. 10 is a block diagram showing configuration of the display driver 30.

The display driver 30 includes a shift register 100, a line latch 110, a reference voltage generation circuit 120, a digital/analog converter (DAC) 130 (voltage select circuit in a broad sense), a switch control circuit 140, and a driver circuit 150.

The DAC 130 has the function of the drive voltage generation circuit GEN-n shown in FIG. 3.

The shift register 100 fetches the display data for one horizontal scanning period by shifting the display data input in series in pixel units in synchronization with a clock signal CLK, for example. The clock signal CLK is supplied from the display controller 38.

In the case where one pixel is made up of an R signal, G signal, and B signal, six bits each, one pixel is made up of 18 bits.

The display data fetched in the shift register 100 is latched by the line latch 110 at timing of a latch pulse signal LP. The latch pulse signal LP is input at a horizontal scanning cycle timing.

The reference voltage generation circuit 120 generates a plurality of reference voltages, each of the reference voltages corresponding to the display data. In more detail, the reference voltage generation circuit 120 generates a plurality of reference voltages V0 to V6, each of the reference voltages corresponding to the 6-bit display data, based on the high-potential-side system power supply voltage VDDH and the low-potential-side system ground power supply voltage VSSH.

The DAC 130 generates the drive voltage corresponding to the display data output from the line latch 110 in output line units. In more detail, the DAC 130 selects the reference voltage corresponding to the display data for one output line which is output from the line latch 110 from the reference voltages V0 to V63 generated by the reference voltage generation circuit 120, and outputs the selected reference voltage as the drive voltage.

The driver circuit 150 drives a plurality of output lines, each of the output lines being connected with one of the data lines of the display panel 20. In more detail, the driver circuit 150 drives the output line based on the drive voltage generated by the DAC 130 in output line units. The driver circuit 150 drives the output line by the data line driver circuits DRV-1 to DRV-N shown in FIG. 3. The data line driver circuits DRV-1 to DRV-N are formed by voltage-follower-connected operational amplifiers. The first and second switching elements are provided for each output line as shown in FIG. 3. In FIG. 10, the high-potential-side system power supply voltage VDDH is used as the first power supply voltage PV1. The low-potential-side system ground power supply voltage VSSH is used as the second power supply voltage PV2. In this case, the first power supply voltage PV1 is the high-potential-side power supply voltage of the data line driver circuits DRV-1 to DRV-N, and the second power supply voltage PV2 is the low-potential-side power supply voltage of the data line driver circuits DRV-1 to DRV-N.

The switch control circuit 140 includes the control circuits SWC-1 to SWC-N shown in FIG. 3, and generates the first and second switch control signals SC1-1 to SC1-N and SC2-1 to SC2-N. The first switch control signals SC1-1 to SC1-N are used to control the first switching elements SW1-1 to SW1-N provided in the driver circuit 150. The second switch control signals SC2-1 to SC2-N are used to control the second switching elements SW2-1 to SW2-N provided in the driver circuit 150.

The switch control circuit includes first and third divisional period setting registers in data line units, and generates the first switch control signals SC1-1 to SC1-N which are set at a logical level H for a period corresponding to the values set in the first and third divisional period setting registers as shown in FIGS. 7 and 8. The switch control circuit 140 includes second and fourth divisional period setting registers in data line units, and generates the second switch control signals SC2-1 to SC2-N which are set at a logical level H for a period corresponding to the values set in the second and fourth divisional period setting registers as shown in FIGS. 7 and 8.

In the display driver 30 having the above-described configuration, the display data for one horizontal scanning period fetched by the shift register 100 is latched by the line latch 110, for example. The drive voltage is generated in output line units by using the display data latched by the line latch 110. The data lines DL1 to DLN connected with the output lines OL-1 to OL-N are precharged by the switch control circuit 140 before the driver circuit 150 drives each output line based on the drive voltage generated by the DAC 130.

Each of the switch control circuits SWC-1 to SWC-N performs two-stage precharging in the precharge period based on at least part of the display data in the horizontal scanning period immediately before the current horizontal scanning period. Therefore, each of the switch control circuits SWC-1 to SWC-N determines the first to fourth divisional periods DT1 to DT4 based on at least part of the display data in the horizontal scanning period immediately before the current horizontal scanning period. Specifically, each of the switch control circuits SWC-1 to SWC-N includes a plurality of sets of register groups, each set including the first to fourth divisional period setting registers. The control circuit selects one of the sets based on at least part of the display data in the horizontal scanning period immediately before the current horizontal scanning period, and determines the first to fourth divisional periods DT1 to DT4 based on the first to fourth divisional period setting registers in the selected set.

The switch control circuits SWC-1 to SWC-N may respectively include the display data holding circuits HLD-1 to HLD-N, for example. The display data holding circuits HLD-1 to HLD-N hold at least part of the display data D-1 to D-N corresponding to the data lines DL1 to DLN, respectively. If the display data consists of six bits (D5 to D0), a part of the display data is one of 1-5 bits from the most significant bit (MSB) D5. The entirety of the display data is made up of D5 to D0.

Figure 11:
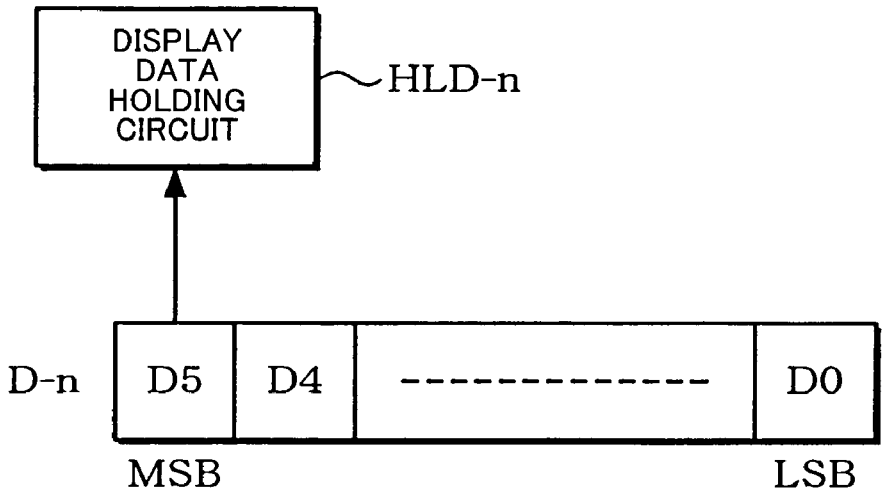
FIG. 11 illustrates holding higher-order one bit of display data by a display data holding circuit.

The switch control circuit SWC-n performs precharge control of the data line DLn. As shown in FIG. 11, the most significant bit D5 which is the higher-order one bit of the display data D-n in the horizontal scanning period immediately before the current horizontal scanning period is held by the display data holding circuit HLD-n, for example.

FIG. 12 shows gray-scale values represented by six bits of display data. Whether the gray-scale value represented by the display data belongs to the range of 0-31 or the range of 32-63 can be distinguished by referring to the most significant bit D5 of the display data holding circuit HLD-n.

When the most significant bit D5 of the display data in the horizontal scanning period immediately before the current horizontal scanning period is "1", it is determined that the gray-scale value is a large value. When the display panel 20 is in the normally white mode, the switch control circuit SWC-n generates the first and second switch control signals SC1-n and SC2-n so that the lengths of the first and third divisional periods DT1 and DT3 (first period T1) are smaller and the lengths of the second and fourth divisional periods DT2 and DT4 (second period T2) are larger in the current horizontal scanning period.

When the most significant bit D5 of the display data in the horizontal scanning period immediately before the current horizontal scanning period is "0", it is determined that the gray-scale value is a small value. When the display panel 20 is in the normally white mode, the switch control circuit SWC-n generates the first and second switch control signals SC1-n and SC2-n so that the lengths of the first and third divisional periods DT1 and DT3 (first period T1) are larger and the lengths of the second and fourth divisional periods DT2 and DT4 (second period T2) are smaller in the current horizontal scanning period.

When the data line is precharged by the first and second switch control signals SC1-n and SC2-n generated by the switch control circuit SWC-n, the driver circuit 150 drives the output line based on the drive voltage generated by the DAC 130 after the first or second precharge period.

In FIG. 11, the display data holding circuit HLD-n may be omitted. In this case, information which specifies the set including the first to fourth divisional period setting registers used in the current horizontal scanning period may be stored based on the most significant bit D5 of the display data in the horizontal scanning period immediately before the current horizontal scanning period.

FIGS. 11 and 12 illustrate the case where the first to fourth divisional periods in the current horizontal scanning period are determined based on the higher-order one bit of the display data in the horizontal scanning period immediately before the current horizontal scanning period. However, the number of higher-order bits of the display data is not limited.

The switch control circuit SWC-n includes $2^K$ (K is a natural number) sets of register groups, each set including the first to fourth divisional period setting registers, and selects one of the $2^K$ sets of register groups based on the higher-order K bits of the display data in the horizontal scanning period immediately before the current horizontal scanning period. The switch control circuit SWC-n controls the first and second switching elements SW1-n and SW2-n in each of the first to fourth divisional periods corresponding to the values set in the first to fourth divisional period setting registers in the selected set.

Figure 13A:
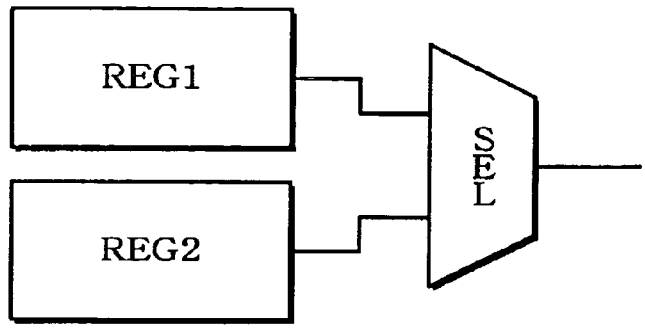
FIGS. 13A, 13B, and 13C are diagrams for illustrating determining first to fourth divisional periods in a current horizontal scanning period based on higher-order one to three bits of display data in the horizontal scanning period immediately before the current horizontal scanning period.
Figure 13B:
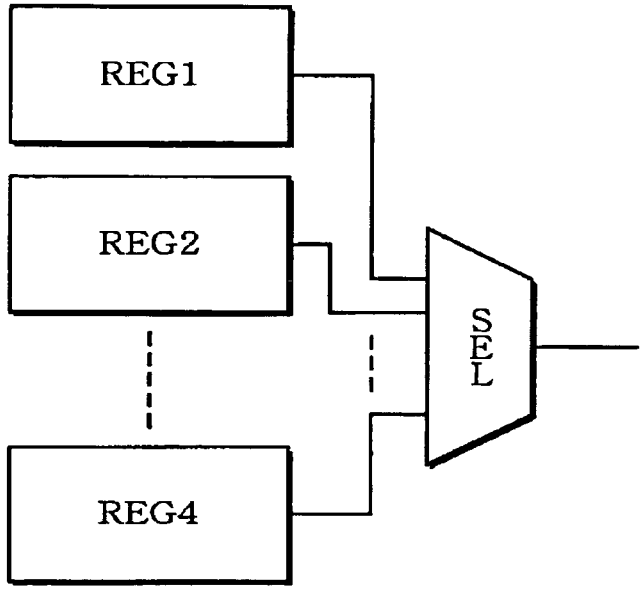
Figure 13C:
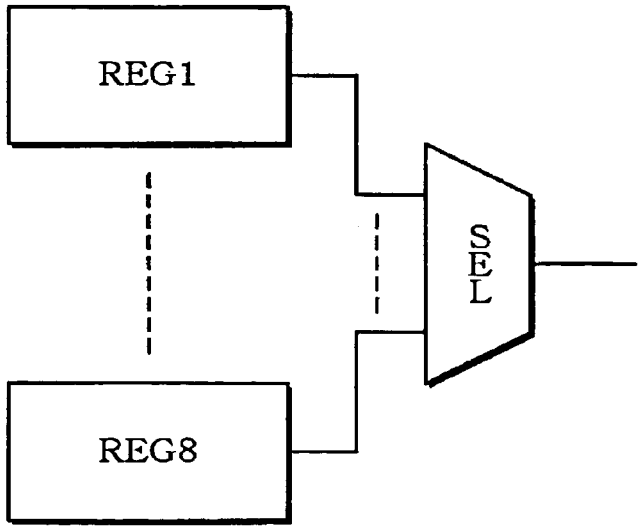

FIGS. 13A, 13B, and 13C are diagrams for illustrating determining first to fourth divisional periods in a current horizontal scanning period based on higher-order one to three bits of display data in the horizontal scanning period immediately before the current horizontal scanning period. In FIGS. 13A, 13B, and 13C, each set including the first to fourth divisional period setting registers is denoted by REG.

FIG. 13A shows the case where K is one. Specifically, the switch control circuit SWC-n includes two sets of register groups REG1 and REG2, each set including the first to fourth divisional period setting registers. One of the two sets of register groups REG1 and REG2 is selected by a selector SEL based on the higher-order one bit of the display data in the horizontal scanning period immediately before the current horizontal scanning period. The first and second switching elements SW1-n and SW2-n are controlled in each of the first to fourth divisional periods corresponding to the values set in the first to fourth divisional period setting registers in the selected set.

FIG. 13B shows the case where K is two. Specifically, the switch control circuit SWC-n includes four sets of register groups REG1 to REG4, each set including the first to fourth divisional period setting registers. One of the four sets of register groups REG1 to REG4 is selected by the selector SEL based on the higher-order two bits of the display data in the horizontal scanning period immediately before the current horizontal scanning period. The first and second switching elements SW1-n and SW2-n are controlled in each of the first to fourth divisional periods corresponding to the values set in the first to fourth divisional period setting registers in the selected set.

FIG. 13C shows the case where K is three. Specifically, the switch control circuit SWC-n includes eight sets of register groups REG1 to REG8, each set including the first to fourth divisional period setting registers, and one set is selected in the same manner as described above.

Figure 14:
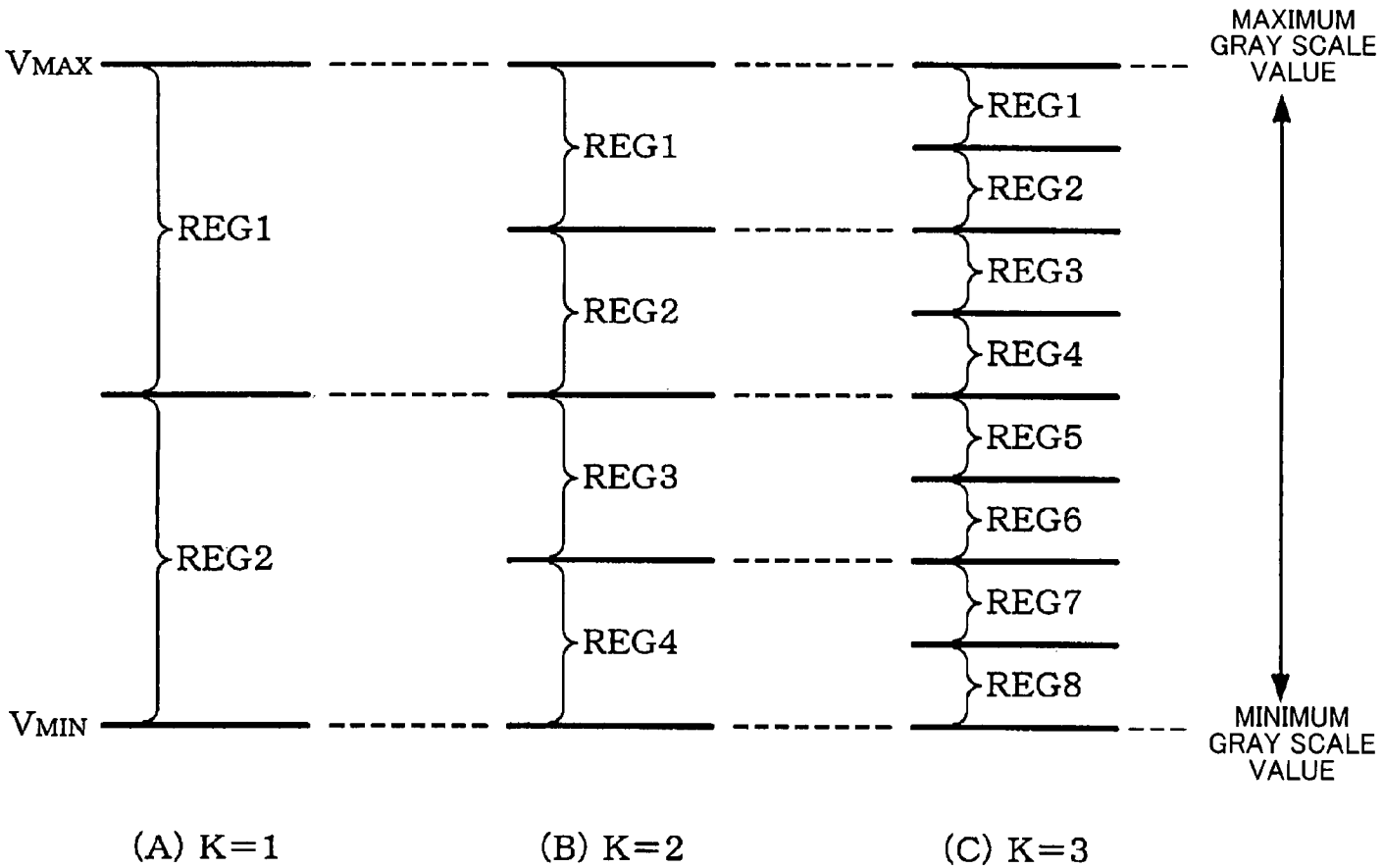
FIG. 14 schematically showing the relationship between gray-scale values and register groups.

FIG. 14 schematically shows the relationship between gray-scale values and the register groups.

The gray-scale value corresponds to the drive voltage one to one. Therefore, selecting the register group based on the higher-order K bits of the display data which represents the gray-scale value in the horizontal scanning period immediately before the current horizontal scanning period means selecting the register group corresponding to the drive voltage in the horizontal scanning period immediately before the current horizontal scanning period.

Therefore, optimum precharging can be realized by setting values for setting the first to fourth divisional periods which should be set corresponding to the drive target in the first to fourth divisional period setting registers in each register group.

Figure 15:
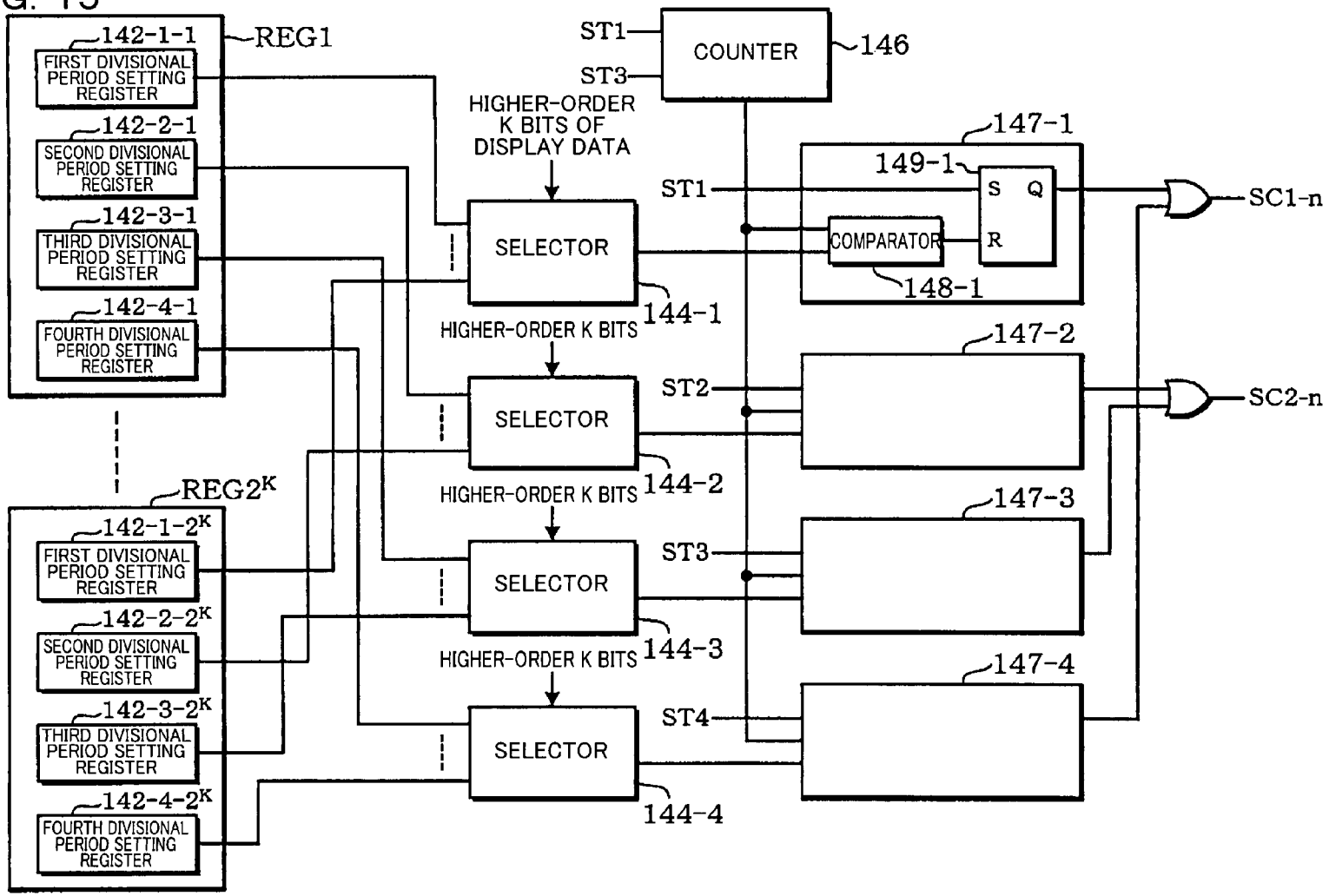
FIG. 15 is a block diagram showing configuration of a switch control circuit according to one embodiment of the present invention.

FIG. 15 shows a configuration example of the switch control circuit SWC-n included in the switch control circuit 140. Other switch control circuits included in the switch control circuit 140 have the same configuration as the switch control circuit SWC-n.

The switch control circuit SWC-n includes a plurality of sets of register groups REG1 to REG$2^K$, each set including the first to fourth divisional period setting registers 142-1 to 142-4. In FIG. 15, a symbol which specifies the set is attached to each of the first to fourth divisional period setting registers 142-1 to 142-4.

One of the sets of register groups REG1 to REG$2^K$ is selected by selectors 144-1 to 144-4. The selectors 144-1 to 144-4 selectively output the values set in the first to fourth divisional period setting registers in one of the sets based on the higher-order K bits of the display data in the horizontal scanning period immediately before the current horizontal scanning period. The first switch control signal SC1-n having a pulse width corresponding to the value set in the first divisional period setting register 142-1 or the fourth divisional period setting register 142-4 in the set selected based on the higher-order K bits of the display data in the horizontal scanning period immediately before the current horizontal scanning period is generated as shown in FIG. 7 or 8. The second switch control signal SC1-n having a pulse width corresponding to the value set in the second divisional period setting register 142-2 or the third divisional period setting register 142-3 in the set selected based on the higher-order K bits of the display data in the horizontal scanning period immediately before the current horizontal scanning period is generated as shown in FIG. 7 or 8. The values set in the first to fourth divisional period setting registers 142-1 to 142-4 in each set are set by the display controller 38.

The switch control circuit SWC-n includes a counter 146 and switch control signal generation circuits 147-1 to 147-4. The counter 146 counts up in synchronization with a given clock signal. The switch control signal generation circuit 147-1 generates the first switch control signal SC1-n which specifies the first divisional period DT1. The switch control signal generation circuit 147-2 generates the second switch control signal SC2-n which specifies the second divisional period DT2. The switch control signal generation circuit 147-3 generates the second switch control signal SC2-n which specifies the third divisional period DT3 . The switch control signal generation circuit 147-4 generates the first switch control signal SC1-n which specifies the fourth divisional period DT4.

The switch control signal generation circuit 147-1 includes a comparator 148-1 and an RS flip-flop 149-1, for example. The comparator 148-1 compares the counter value of the counter 146 with the value set in the first divisional period setting register 142-1 in the set selected by the selector 144-1, and outputs a pulse when these values coincide. The RS flip-flop 149-1 is set by a first start signal ST1, and is reset when the comparator 148-1 detects that the counter value of the counter 146 coincides with the value set in the first divisional period setting register 142-1. This configuration allows start of the first divisional period DT1 to be designated by the first start signal ST1 and the length of the first divisional period DT1 to be designated by the value set in the first divisional period setting register 142-1.

The switch control signal generation circuits 147-1 to 147-4 have the same configuration. Therefore, description of the switch control signal generation circuits 147-2 to 147-4 is omitted.

The first and third start signals ST1 and ST3 may be output at timing determined in advance as timing dependent on the display panel 20 as the drive target or the like, or may be output at timing set by the display controller 38. The start time of the precharge period shown in FIG. 6 or 9 can be designated by the first and third start signals ST1 and ST3.

The second and fourth start signals ST2 and ST4 are determined depending on the display panel 20 as the drive target or the like. Power consumption can be reduced by reducing the second and fourth divisional periods DT2 and DT4 . There may be a case where the voltage of the data line cannot be set in time if the second and fourth divisional periods DT2 and DT4 are excessively increased.

Figure 16:
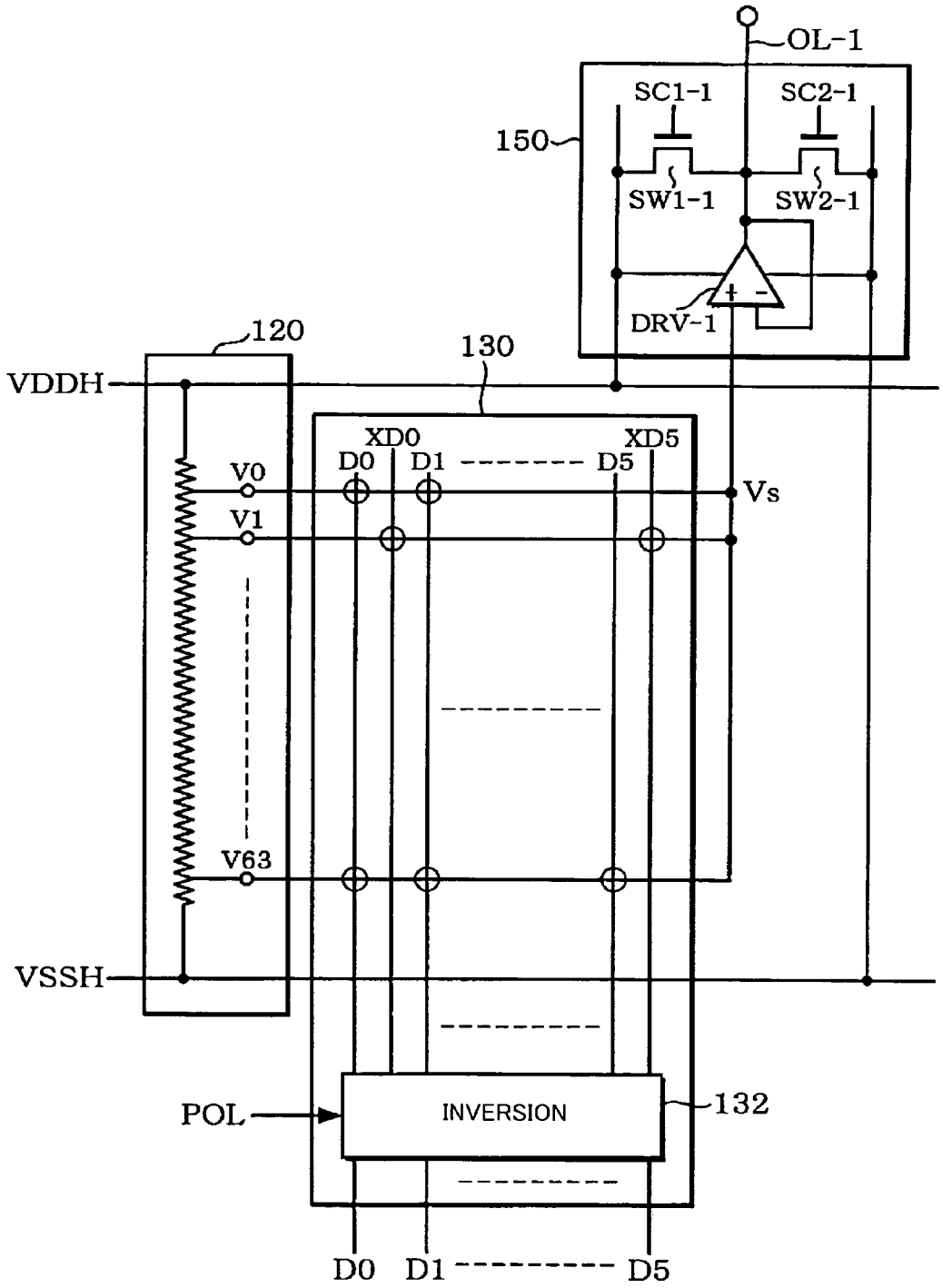
FIG. 16 is a circuit diagram showing a connection example of a reference voltage generation circuit, a DAC, and a driver circuit according to one embodiment of the present invention.

FIG. 16 schematically shows the configuration of the reference voltage generation circuit 120, the DAC 130, and the driver circuit 150. Although only the data line driver circuit DRV-1 of the driver circuit 150 is shown in this figure, the same description also applies to other driver circuits.

In the reference voltage generation circuit 120, a resistor circuit is connected between the system power supply voltage VDDH and the system ground power supply voltage VSSH. The reference voltage generation circuit 120 generates a plurality of divided voltages obtained by dividing the voltage between the system power supply voltage VDDH and the system ground power supply voltage VSSH by the resistor circuit as the reference voltages V0 to V63. In the polarity inversion drive, since the voltage is not symmetrical between the case where the polarity is positive and the case where the polarity is negative, a positive reference voltage and a negative reference voltage are generated. FIG. 16 shows one of them.

The DAC 130 may be realized by a ROM decoder circuit. The DAC 130 selects one of the reference voltages V0 to V63 based on the 6-bit display data, and outputs the selected reference voltage to the data line driver circuit DRV-1 as the select voltage Vs. The voltage selected based on the corresponding 6-bit display data is output to other data line driver circuits DRV-2 to DRV-N.

The DAC 130 includes an inversion circuit 132. The inversion circuit 132 reverses the display data based on the polarity inversion signal POL. The 6-bit display data D0 to D5 and 6-bit reversed display data XD0 to XD5 are input to the DAC 130. The reversed display data XD0 to XD5 is obtained by reversing the display data D0 to D5, respectively. In the DAC 130, one of the multi-valued reference voltages V0 to V63 generated by the reference voltage generation circuit is selected based on the display data.

When the logical level of the polarity inversion signal POL is H, the reference voltage V2 is selected corresponding to the 6-bit display data D0 to D5 "000010" (=2), for example. When the logical level of the polarity inversion signal POL is L, the reference voltage is selected by the reversed display data XD0 to XD5 obtained by reversing the display data D0 to D5. Specifically, the reversed display data XD0 to XD5 becomes "111101" (=61), whereby the reference voltage V61 is selected.

The select voltage Vs selected by the DAC 130 is supplied to the data line driver circuit DRV-1.

After the output line OL-1 is precharged in the divisional period designated by the first and second switch control signals SC1-1 and SC2-2, the data line driver circuit DRV-1 drives the output line OL-1 based on the select voltage Vs.

Figure 17:
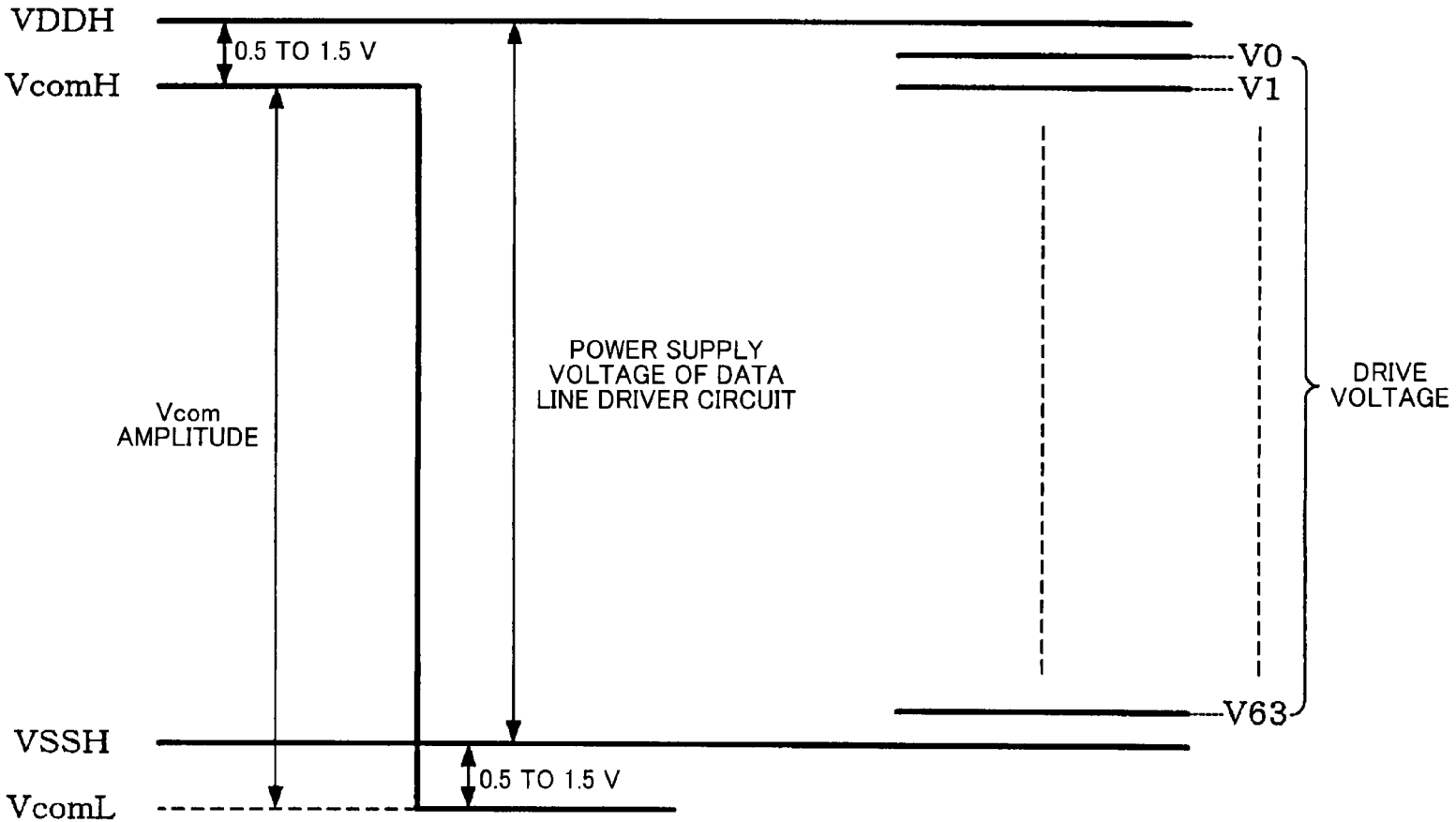
FIG. 17 schematically shows the relationship of voltages in one embodiment of the present invention.

FIG. 17 schematically shows the relationship of voltages in this embodiment. In this embodiment, the high-potential-side voltage VcomH of the common electrode voltage Vcom is about 0.5-1.5 V lower than the high-potential-side system power supply voltage VDDH. The low-potential-side voltage VcomL of the common electrode voltage Vcom is about 0.5-1.5 V lower than the low-potential-side system ground power supply voltage VSSH.

The high-potential-side system power supply voltage VDDH and the low-potential-side system ground power supply voltage VSSH are respectively used as the high-potential-side power supply voltage and the low-potential-side power supply voltage of the data line driver circuits DRV-1 to DRV-N. In FIG. 16, the first power supply voltage PV1 connected with the first switching elements SW1-1 to SW1-N is the high-potential-side power supply voltage of the data line driver circuits DRV-1 to DRV-N. The second power supply voltage PV2 connected with the second switching elements SW2-1 to SW2-N is the low-potential-side power supply voltage of the data line driver circuits DRV-1 to DRV-N.

The first power supply voltage PV1 connected with the first switching elements SW1-1 to SW1-N is not limited to the high-potential-side power supply voltage of the data line driver circuits DRV-1 to DRV-N.

The second power supply voltage PV2 connected with the second switching elements SW2-1 to SW2-N is not limited to the low-potential-side power supply voltage of the data line driver circuits DRV-1 to DRV-N.

Figure 18:
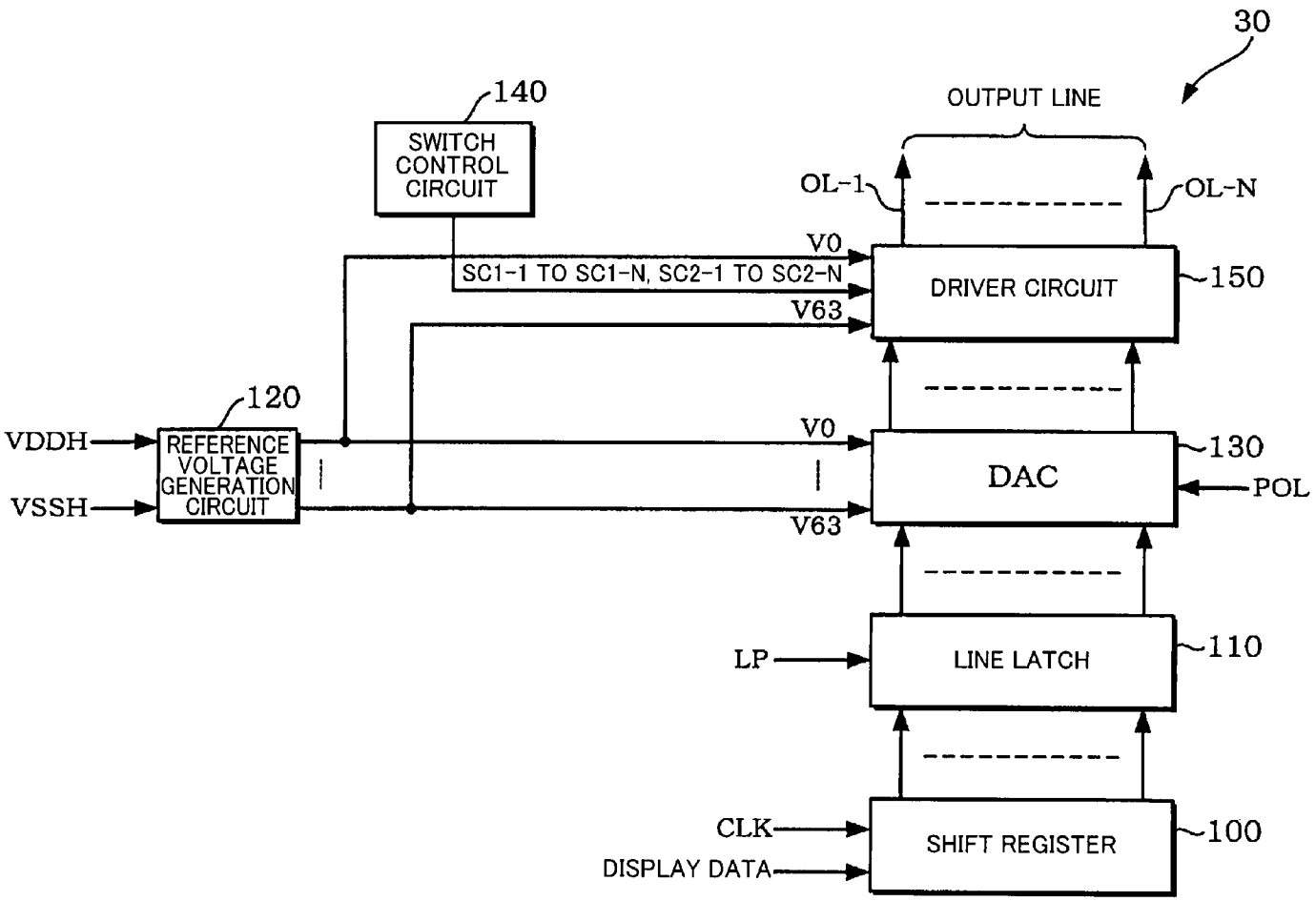
FIG. 18 is a block diagram showing another configuration of a display device according to one embodiment of the present invention.

FIG. 18 shows a block diagram of another configuration example of the display driver 30. In FIG. 18, sections the same as the sections shown in FIG. 10 are denoted by the same symbols. Description of these sections is appropriately omitted. The display driver in FIG. 18 differs from the display driver in FIG. 10 in the first and second power supply voltages connected with the first and second switching elements of the driver circuit 150.

Figure 19:
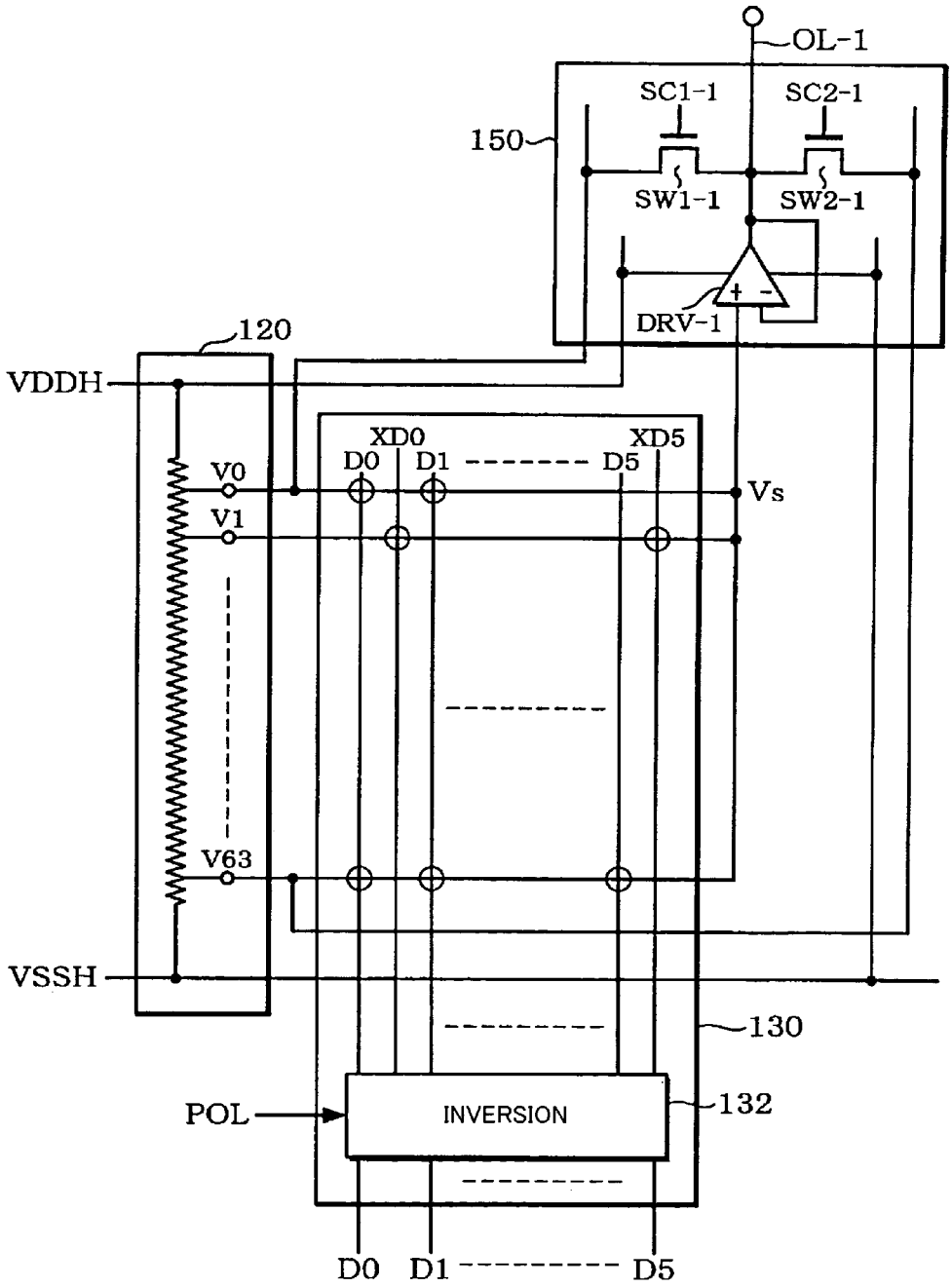
FIG. 19 is a circuit diagram showing another connection example of a reference voltage generation circuit, a DAC, and a driver circuit according to one embodiment of the present invention.

FIG. 19 schematically shows the configuration of the reference voltage generation circuit 120, the DAC 130, and the driver circuit 150 of FIG. 18. Note that components corresponding to those of FIG. 16 are denoted by the same reference numbers and further description thereof is omitted.

The first power supply voltage PV1 is the reference voltage V0 (maximum value of the drive voltage) which is the highest voltage of the reference voltages V0 to V63. The second power supply voltage PV2 is the reference voltage V63 (minimum value of the drive voltage) which is the lowest voltage of the reference voltages V0 to V63.

In this case, the high-potential-side power supply voltage of the data line driver circuit DRV-1 is the system power supply voltage VDDH, and the low-potential-side power supply voltage of the data line driver circuit DRV-1 is the system ground power supply voltage VSSH. This is because a margin is necessary in the case of driving the output line based on the reference voltages V0 and V63 generated by the reference voltage generation circuit 120.

4. Other Display Device

The case where the display driver in this embodiment is applied to a display panel formed by using a low-temperature poly-silicon (hereinafter abbreviated as "LTPS") process is described below.

According to the LTPS process, a driver circuit and the like can be directly formed on a panel substrate (glass substrate, for example) on which a pixel including a TFT and the like is formed. This reduces the number of parts, whereby the size and weight of the display panel can be reduced. Moreover, LTPS enables the pixel size to be reduced by applying a conventional silicon process technology while maintaining the aperture ratio. Furthermore, LTPS has high charge mobility and small parasitic capacitance in comparison with amorphous silicon (a-Si). Therefore, the charge period of the pixel formed on the substrate can be secured even if the pixel select period for one pixel is reduced due to an increase in the screen size, whereby the image quality can be improved.

Figure 20:
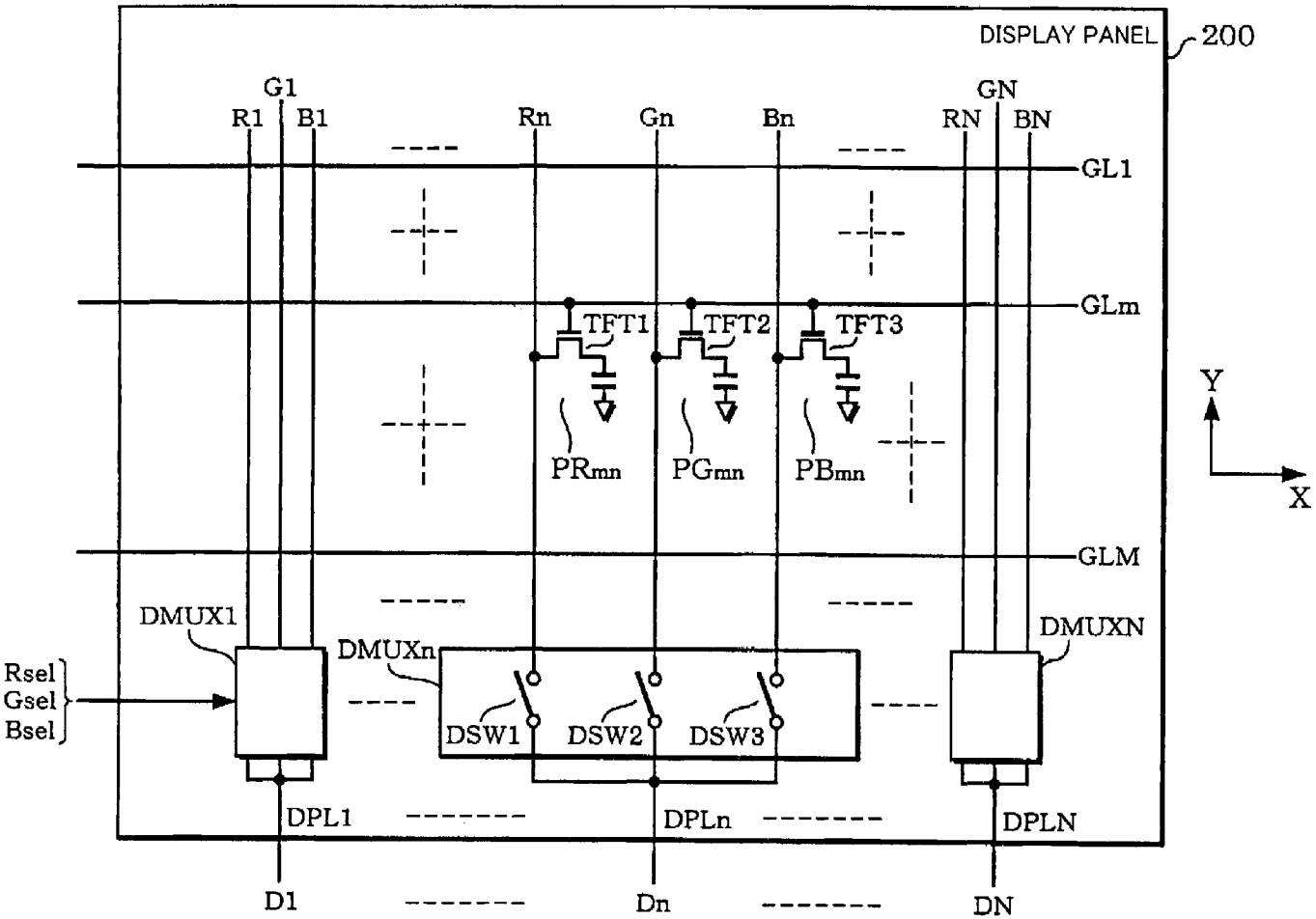
FIG. 20 is a diagram schematically showing configuration of a display panel formed by an LTPS process.

FIG. 20 schematically shows configuration of a display panel formed by an LTPS process. A display panel 200 (electro-optical device in a broad sense) includes a plurality of scanning lines, a plurality of color component data lines (data lines in a broad sense), and a plurality of pixels. The scanning lines and the color component data lines are disposed to intersect. A pixel is specified by the scanning line and the color component data line.

In the display panel 200, the pixels are selected by the scanning line (GL) and the data signal supply line (DPL) in three pixel units. A color component signal (color component data in a broad sense) transmitted through one of the three color component data lines (R, G, B) (data lines in a broad sense) corresponding to the data signal supply line is written in the selected pixel. Each pixel includes a TFT and a pixel electrode. The data signal supply line is connected with the output line of the display driver.

In the display panel 200, a plurality of scanning lines GL1 to GLM, arranged in the Y direction and extending in the X direction, and a plurality of data signal supply lines DPL1 to DPLN, arranged in the X direction and extending in the Y direction, are formed on the panel substrate. A plurality of sets of first to third color component data lines (R1, G1, B1) to (RN, GN, BN), arranged in the X direction and extending in the Y direction, are formed on the panel substrate.

R pixels (first color component pixels) PR (PR 11 to PRMN) are formed at the intersecting points of the scanning lines GL1 to GLM and the first color component data lines R1 to RN. G pixels (second color component pixels) PG (PG 11 to PGMN) are formed at the intersecting points of the scanning lines GL1 to GLM and the second color component data lines G1 to GN. B pixels (third color component pixels) PB (PB11 to PBMN) are formed at the intersecting points of the scanning lines GL1 to GLM and the third color component data lines B1 to BN.

Demultiplexers DMUX1 to DMUXN are provided on the panel substrate corresponding to the data signal supply lines. The demultiplexers DMUX1 to DMUXN are controlled by demultiplex control signals Rsel, Gsel, and Bsel.

Figure 21:
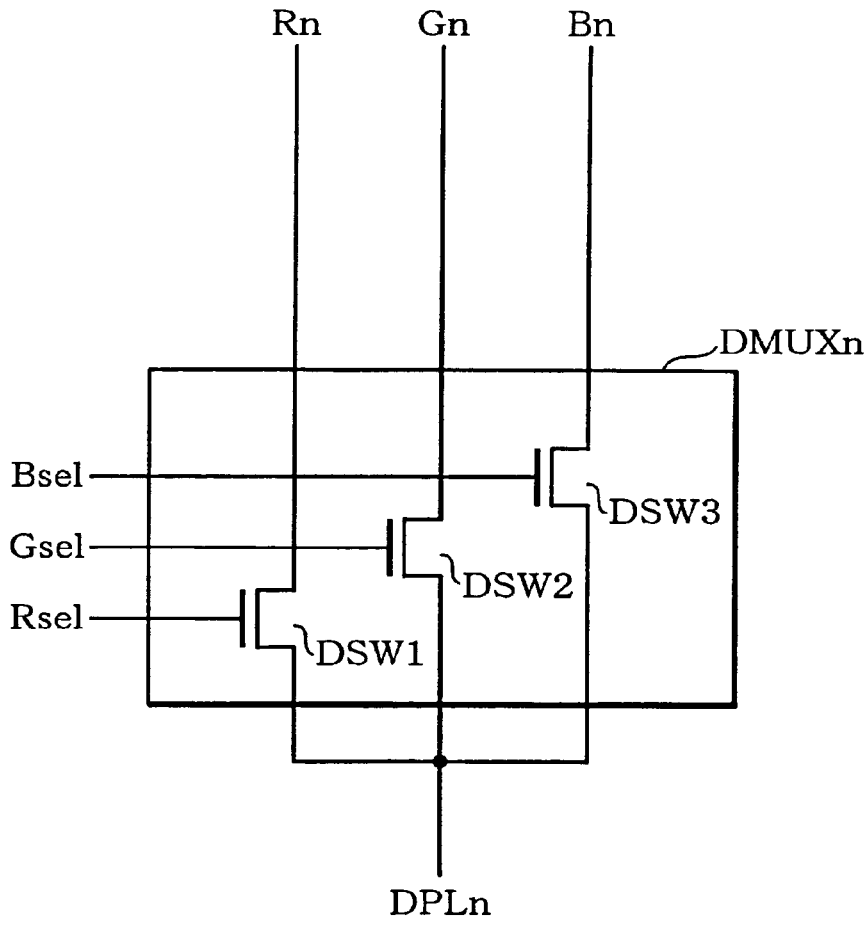
FIG. 21 is a diagram schematically showing configuration of a demultiplexer.

FIG. 21 schematically shows configuration of the demultiplexer DMUXn.

The demultiplexer DMUXn includes first to third demultiplex switching elements DSW1 to DSW3.

The first to third color component data lines (Rn, Gn, Bn) are connected with the output side of the demultiplexer DMUXn. The data signal supply line DPLn is connected with the input side of the demultiplexer DMUXn. The demultiplexer DMUXn electrically connects the data signal supply line DPLn with one of the first to third color component data lines (Rn, Gn, Bn) in response to the demultiplex control signals Rsel, Gsel, and Bsel. The demultiplex control signals are input in common to the demultiplexers DMUX1 to DMUXN.

Figure 22:
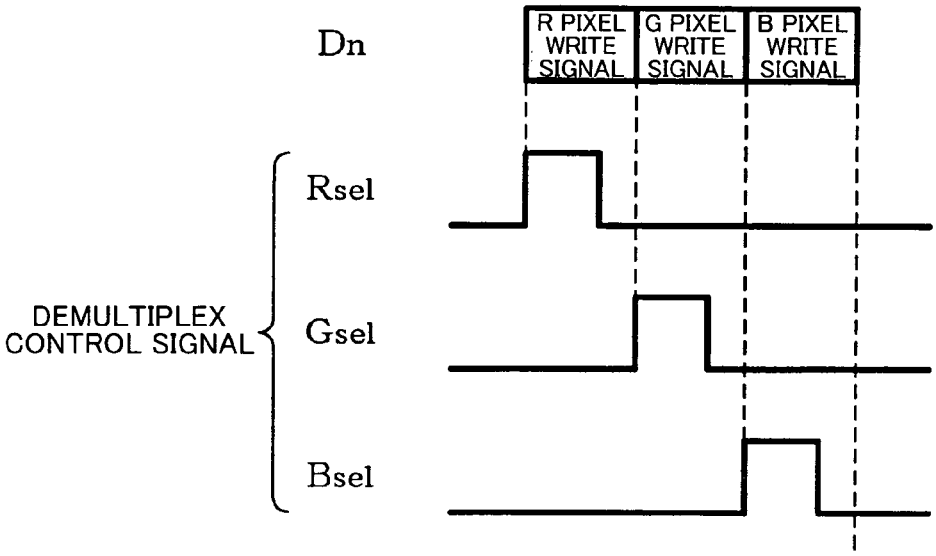
FIG. 22 is a diagram for illustrating the relationship between demultiplex control signals and write signals which are time-divided for each color component pixel and corresponding to display data of each color component.

The demultiplex control signals Rsel, Gsel, and Bsel are supplied from the display driver provided outside the display panel 200, for example. In this case, the display driver outputs voltages (data signals or color component data), which are time-divided in units of color component pixels and correspond to the display data for each color component, to the data signal supply line DPLn, as shown in FIG. 22. The display driver generates the demultiplex control signals Rsel, Gsel, and Bsel for selectively outputting the voltage corresponding to the color component data to the color component data line in synchronization with the time-division timing, and outputs the demultiplex control signals to the display panel 200.

The precharge technology in this embodiment can also be applied to such a display panel 200.

Figure 23:
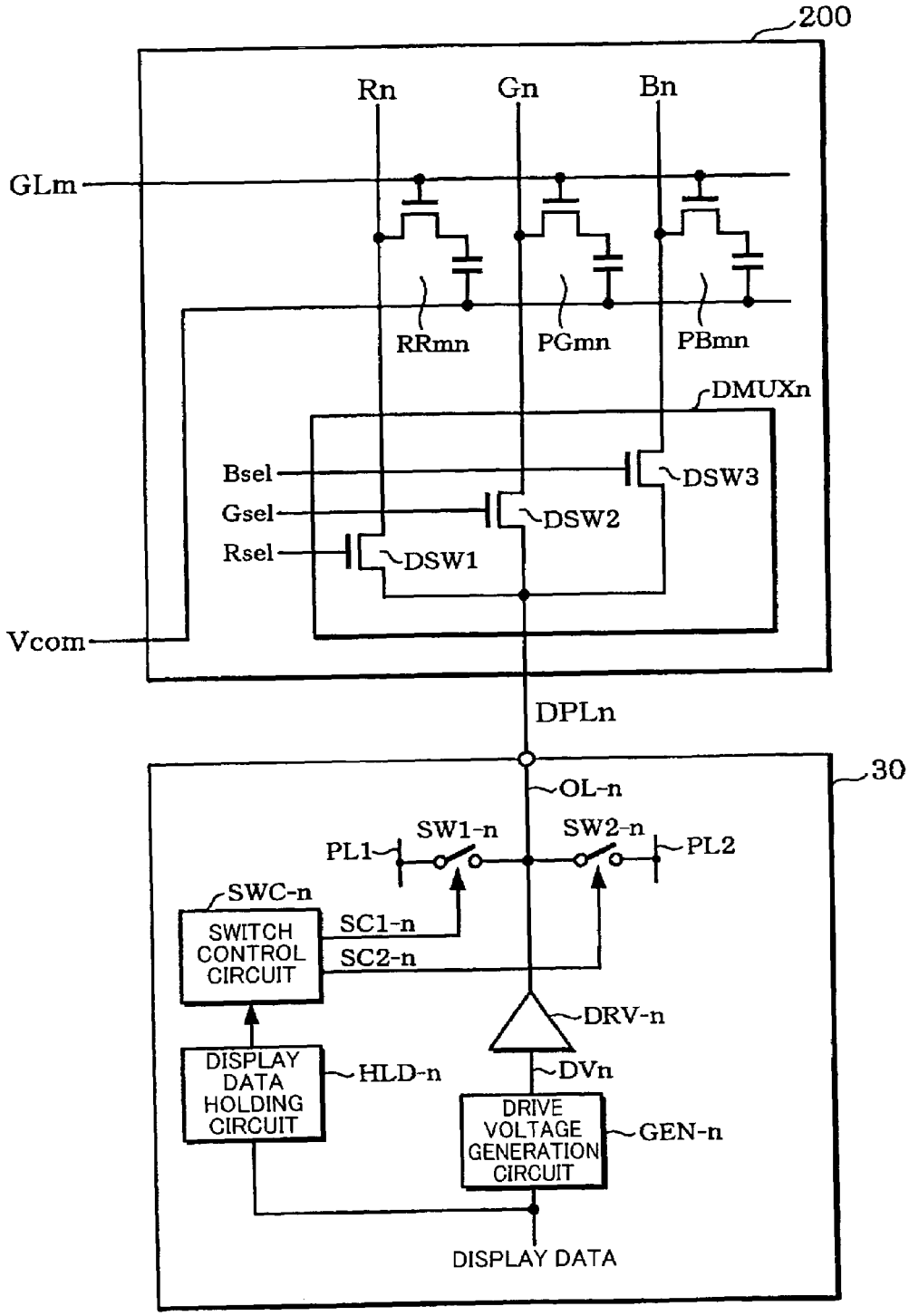
FIG. 23 is a block diagram showing main components of the display panel of FIG. 20 when the display driver according to one embodiment of the present invention is applied to the display panel.

FIG. 23 is a block diagram showing main components of the display panel 200 when the display driver 30 is applied to the display panel 200. Note that the components corresponding to those in FIG. 3 or 20 are denoted by the same reference numbers and further description thereof is omitted.

The display panel 200 includes a plurality of scanning lines GL1 to GLM, a plurality of data lines (R1, G1, B1) to (RN, GN, BN), and a plurality of pixels (PR11, PG11, PB11) to (PRMN, PGMN, PBMN), each of the pixels being connected with one of the scanning lines and one of the data lines. The display panel 200 includes a plurality of demultiplexers DMUX1 to DMUXN, each of the demultiplexers including first to third demultiplex switching elements DSW1 to DSW3 which are exclusively controlled based on first to third demultiplex control signals, one end of each of the demultiplex switching elements being connected with a data signal supply line to which time-divided drive voltages corresponding to first to third color component data are supplied, and the other end of each of the demultiplex switching elements being connected with the pixel for a jth color component ($1 \leqq j \leqq 3$, j is an integer).

The display driver 30 includes the data line driver circuits DRV-1 to DRV-N, the first switching elements SW1-1 to SW1-N, the second switching elements SW2-1 to SW2-N, and the switch control circuits SWC-1 to SWC-N.

The data line driver circuit DRV-n drives the output line OL-n connected with the data signal supply line DPLn based on the drive voltages corresponding to the color component data obtained by time-division. The switch control circuit SWC controls the first and second switching elements SW1-n and SW2-n.

In FIG. 23, the lengths of the first and second periods shown in FIG. 4 are determined based on at least part of the color component data of the display data in the horizontal scanning period immediately before the current horizontal scanning period.

Figure 24:
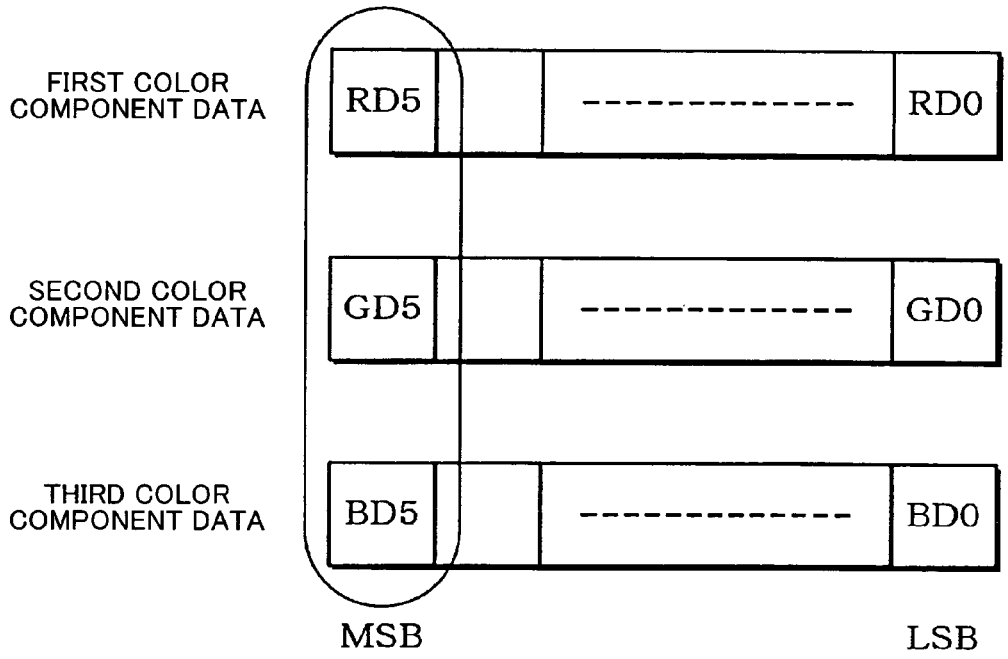
FIG. 24 is a diagram for illustrating most significant bits of first to third color component data obtained by time-dividing display data in a horizontal scanning period immediately before a current horizontal scanning period.

Specifically, in the case where the R pixel write signal, G pixel write signal, and B pixel write signal are time-divided as shown in FIG. 22, each pixel write signal is generated based on the color component data included in the display data by time-division. The display data holding circuit HLD-n shown in FIG. 23 holds the most significant bits of the first to third color component data obtained by time-dividing the display data in a horizontal scanning period immediately before the current horizontal scanning period as shown in FIG. 24. In FIG. 24, in the case where the color component data consists of six bits, only the higher-order one bits (RD5, GD5, BD5) of the color component data are held by the display data holding circuit HLD-n.

The switch control circuit SWC-n includes a plurality of registers, each set including the first to fourth divisional period setting registers as described above. The switch control circuit SWC-n includes a decoder circuit which selects one set corresponding to the combination of the higher-order one bits of the color component data held in advance by the display data holding circuit HLD-n.

FIG. 25 is an example of a truth table of a decoder circuit included in the switch control circuit SWC-n. One of the register groups REG1 and REG2 can be selected by the higher-order one bits (RD5, GD5, BD5) of the first to third color component data using the decoder circuit. Specifically, FIG. 25 corresponds to the case where K is one in the same manner as in FIG. 13A.

The display driver 30 may have a configuration in which the display data holding circuit HLD-n is omitted. In this case, the display driver 30 may hold data for generating the first and second switch control signals SC1-n and SC2-n in the current horizontal scanning period based on at least part of the color component data of the display data supplied corresponding to the data line DLn in the horizontal scanning period immediately before the current horizontal scanning period.

FIGS. 24 and 25 illustrate the case of using the higher-order one bits of the color component data. However, the same description applies to the case of using the higher-order two bits of the color component data.

Figure 26:
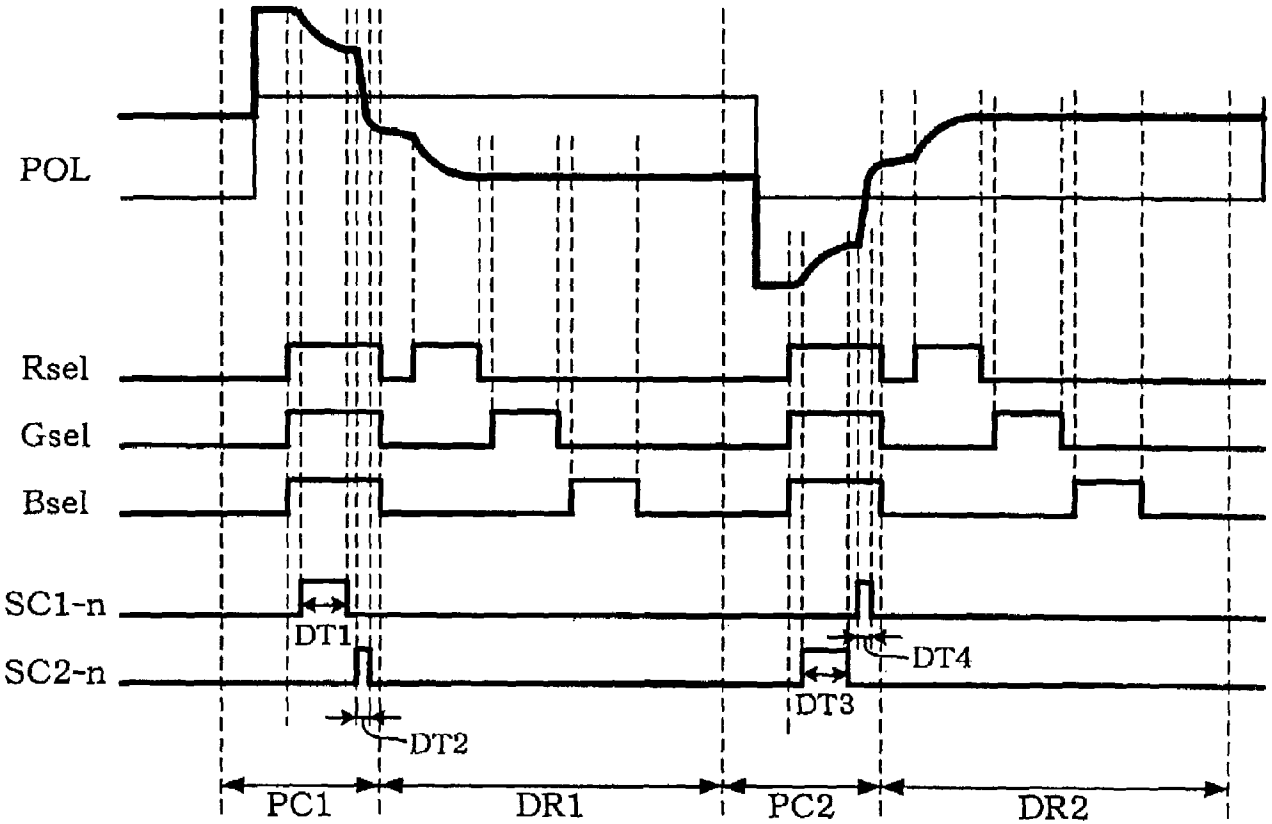
FIG. 26 shows an example of a timing chart of precharging implemented by the configuration shown in FIG. 23.

FIG. 26 is an example of timing chart of precharging implemented by the configuration shown in FIG. 23. FIG. 26 shows only a change in potential of the color component data line Rn. However, the same description applies to the color component data lines Gn and Bn. The same description also applies to other color component data lines.

In order to perform the precharge operation, the data signal supply line DPLn is electrically connected with the first to third color component data lines Rn, Gn, and Bn by turning ON the first to third demultiplex switching elements DSW1 to DSW3 at the same time by the demultiplex control signals Rsel, Gsel, and Bsel. The first and second precharge periods PC1 and PC2 are set in this period.

The switch control circuit SWC-n determines the first and third divisional periods DT1 and DT3 (first period) and the second and fourth divisional periods DT2 and DT4 (second period) based on at least part of the color component data of the display data in the horizontal scanning period immediately before the current horizontal scanning period.

In the drive period DR1 after the first precharge period PC1 and the drive period DR2after the second precharge period PC2, the display panel 200 is driven based on the display data in which the write signals for each pixel are time-divided.

The above-described embodiment illustrates the case where the pixels are selected in units of three pixels corresponding to the R, G, and B color components. However, the present invention is not limited thereto. For example, the present invention can also be applied to the case where the pixels are selected in units of one, two, or four or more pixels.

The above-described embodiment illustrate the case where the lengths of the first and second periods are determined based on at least part of the color component data of the display data in the horizontal scanning period immediately before the current horizontal scanning period. However, the present invention is not limited thereto. The lengths of the first and second periods may be determined based on at least part of one or two types of color component data of the display data in a horizontal scanning period immediately before the current horizontal scanning period.

In FIG. 22, the order in which the first to third demultiplex control signals (Rsel, Gsel, Bsel) go active is not limited to the order in the above-described embodiment.

The above-described embodiment illustrate the case of using the display data in the horizontal scanning period immediately before the current horizontal scanning period. However, the present invention is not limited thereto. The display data in a period two or more horizontal scanning periods before the current horizontal scanning period may be used.

The present invention is not limited to the above-described embodiments, and various modifications can be made within the scope of the present invention.

Part of requirements of any claim of the present invention could be omitted from a dependent claim which depends on that claim. Moreover, part of requirements of any independent claim of the present invention could be made to depend on any other independent claim.

What is claimed is:

1. A driver which supplies data to a data line of a display panel, the driver comprising:

a driver circuit which supplies the data to an output line;

a first switching element connected between the output line and a first power supply line to which a first power supply voltage is supplied;

a second switching element connected between the output line and a second power supply line to which a second power supply voltage is supplied; and a switch control circuit which controls the first switching element and the second switching element, wherein:

a length of a first period and a length of a second period after the first period are determined based on at least a part of display data in a second horizontal scanning period which is immediately before a first horizontal scanning period, the first period and the second period are in the first horizontal scanning period;

the switch control circuit electrically connects the output line to the first power supply line in the first period by setting the first switching element in an ON state and setting the second switching element in an OFF state;

the switch control circuit electrically connects the output line to the second power supply line in the second period by setting the first switching element in an OFF state and setting the second switching element in an ON state;

the switch control circuit sets the first switching element and the second switching element in an OFF state after the second period; and the driver circuit drives the output line after the second period.

2. The driver as defined in claim 1, wherein an absolute value of a difference between the voltage of the data line and the first power supply voltage at the start of the first period is smaller than an absolute value of a difference between the voltage of the data line and the second power supply voltage at the start of the first period.

3. The driver as defined in claim 2, wherein the switch control circuit controls the first switching element and the second switching element so that the first period is longer than the second period.

4. The driver as defined in claim 1, wherein:

the first power supply voltage is higher than the second power supply voltage;

a first precharge period is provided before a drive period in which a polarity of the drive voltage is negative with respect to a reference potential;

a second precharge period is provided before a drive period in which a polarity of the drive voltage is positive with respect to the reference potential;

the switch control circuit sets the first switching element in an ON state and sets the second switching element in an OFF state in a first divisional period within the first precharge period;

the switch control circuit sets the first switching element in an OFF state and sets the second switching element in an ON state in a second divisional period after the first divisional period;

the switch control circuit sets the first switching element in an OFF state and sets the second switching element in an ON state in a third divisional period within the second precharge period; and the switch control circuit sets the first switching element in an ON state and sets the second switching element in an OFF state in a fourth divisional period after the third divisional period.

5. The driver as defined in claim 4, wherein: the switch control circuit includes $2^K$ (K is a natural number) sets of registers, each of the sets including first to fourth divisional period setting registers;

the switch control circuit selects one of the $2^K$ sets of registers based on higher-order K bits of the display data in a horizontal scanning period which is immediately before a current horizontal scanning period; and the switch control circuit controls the first switching element and the second switching element in each of the first to fourth divisional periods corresponding to values set in the first to fourth divisional period setting registers of the selected set.

6. The driver as defined in claim 5, wherein the switch control circuit controls the first switching element and the second switching element so that the first divisional period is longer than the second divisional period and the third divisional period is longer than the fourth divisional period.

7. The driver as defined in claim 4, wherein the switch control circuit controls the first switching element and the second switching element so that the first divisional period is longer than the second divisional period and the third divisional period is longer than the fourth divisional period.

8. The driver as defined in claim 1, wherein the first power supply voltage is a power supply voltage on the high-potential-side of the driver circuit; and the second power supply voltage is a power supply voltage on the low-potential-side of the driver circuit.

9. The driver as defined in claim 1, wherein the first power supply voltage is a maximum value of the drive voltage; and the second power supply voltage is a minimum value of the drive voltage.

10. A display device comprising:

a plurality of scanning lines;

the data line;

a plurality of pixels each of which is connected to one of the scanning lines and the data line; and the driver as defined in claim 1 which drives the data line.

11. A driver which drives a plurality of data lines of a display panel, the display panel including: a plurality of scanning lines; the data lines; a plurality of pixels each of which is connected to one of the scanning lines and one of the data lines; and a plurality of demultiplexers each of which includes first to third demultiplex switching elements which are respectively and exclusively controlled by first to third demultiplex control signals, one end of each of the first to third demultiplex switching elements being connected to one of data signal supply lines to which time-divided drive voltages corresponding to first to third color component data are supplied, and the other end of each of the first to third demultiplex switching elements being connected to one of the pixels for a jth color component ($1 \leqq j \leqq 3$, j is an integer), the driver comprising:

a driver circuit which drives an output line connected to the data signal supply lines by the drive voltages;

a first switching element connected between the output line and a first power supply line to which a first power supply voltage is supplied;

a second switching element connected between the output line and a second power supply line to which a second power supply voltage is supplied; and a switch control circuit which controls the first switching element and the second switching element, wherein:

a length of a first period and a length of a second period after the first period are determined based on at least a part of one of the first to third color component data in display data in a second horizontal scanning period which is immediately before a first horizontal scanning period, the first period and the second period are in the first horizontal scanning period;

the switch control circuit electrically connects the output line to the first power supply line in the first period by setting the first switching element in an ON state and setting the second switching element in an OFF state;

the switch control circuit electrically connects the output line to the second power supply line in the second period by setting the first switching element in an OFF state and setting the second switching element in an ON state;

the switch control circuit sets the first switching element and the second switching element in an OFF state after the second period; and the driver circuit drives the output line after the second period.

12. The driver as defined in claim 11, wherein an absolute value of a difference between each of the voltages of the data lines and the first power supply voltage at the start of the first period is smaller than an absolute value of a difference between each of the voltages of the data lines and the second power supply voltage at the start of the first period.

13. The driver as defined in claim 12, wherein the switch control circuit controls the first switching element and the second switching element so that the first period is longer than the second period.

14. The driver as defined in claim 11, wherein the first power supply voltage is a power supply voltage on the high-potential-side of the driver circuit; and the second power supply voltage is a power supply voltage on the low-potential-side of the driver circuit.

15. The driver as defined in claim 11, wherein the first power supply voltage is a maximum value of the drive voltages; and the second power supply voltage is a minimum value of the drive voltages.

16. The driver as defined in claim 11, wherein:

the first power supply voltage is higher than the second power supply voltage;

a first precharge period is provided before a drive period in which a polarity of the drive voltages are negative with respect to a reference potential;

a second precharge period is provided before a drive period in which a polarity of the drive voltages are positive with respect to the reference potential;

each of the first and second precharge periods includes a period in which each of the data signal supply lines is electrically connected to one of the data lines, each of the data lines being connected to one of the pixels for first to third color components by the first to third demultiplex switching elements;

the switch control circuit sets the first switching element in an ON state and sets the second switching element in an OFF state in a first divisional period within the first precharge period;

the switch control circuit sets the first switching element in an OFF state and sets the second switching element in an ON state in a second divisional period after the first divisional period;

the switch control circuit sets the first switching element in an OFF state and sets the second switching element in an ON state in a third divisional period within the second precharge period; and the switch control circuit sets the first switching element in an ON state and sets the second switching element in an OFF state in a fourth divisional period after the third divisional period.

17. The driver as defined in claim 16, wherein:

the switch control circuit includes $2^K$ (K is a natural number) sets of registers, each of the sets including first to fourth divisional period setting registers;

the switch control circuit selects one of the $2^K$ sets of register groups based on higher-order K bits of one of the first to third color component data obtained by time-dividing the display data in a horizontal scanning period which is immediately before a current horizontal scanning period; and the switch control circuit controls the first switching element and the second switching element in each of the first to fourth divisional periods corresponding to values set in the first to fourth divisional period setting registers of the selected set.

18. The driver as defined in claim 16, wherein the switch control circuit controls the first switching element and the second switching element so that the first divisional period is longer than the second divisional period and the third divisional period is longer than the fourth divisional period.

19. A display device comprising:

the scanning lines;

the data lines;

the pixels each of which is connected to one of the scanning lines and one of the data lines;

the demultiplexers each of which includes the first to third demultiplex switching elements exclusively controlled by the first to third demultiplex control signals, one end of each of the first to third demultiplex switching elements being connected to one of the data signal supply lines to which the time-divided drive voltages corresponding to the first to third color component data are supplied, and the other end of each of the first to third demultiplex switching elements being connected to one of the pixels for a jth color component ($1 \leqq j \leqq 3$, j is an integer); and the driver as defined in claim 16.

20. A method of supplying data to a data line of a display panel, the method comprising:

providing a first switching element connected between the data line and a first power supply line to which a first power supply voltage is supplied, and a second switching element connected between the data line and a second power supply line to which a second power supply voltage is supplied;

determining a length of a first divisiohal period and a length of a second divisional period after the first divisional period within a first precharge period which is provided before a drive period in which a poiarity of a drive voltage corresponding to the data is negative with respect to a reference potential, based on at least a part of the display data in a second horizontal scanning period which is immediately before a first horizontal scanning period, the first divisional period and the second divisional period are in the first horizontal scanning period;

setting the first switching element in an ON state and setting the second switching element in an OFF state in the first divisional period, and setting the first switching element in an OFF state and setting the second switching element in an ON state in the second divisional period; and setting the first switching element and the second switching element in an OFF state after the first precharge period and supplying the data to the data line.

21. The drive method as defined in claim 20, wherein the first divisional period is longer than the second divisional period.

22. A method of driving a plurality of data lines of a display panel, the display panel including: a plurality of scanning lines; the data lines; a plurality of pixels each of which is connected to one of the scanning lines and one of the data lines; and a plurality of demultiplexers each of which includes first to third demultiplex switching elements which are respectively and exclusively controlled by first to third demultiplex control signals, one end of each of the first to third demultiplex switching elements being connected to one of data signal supply lines to which time-divided drive voltages corresponding to first to third color component data are supplied, and the other end of each of the first to third demultiplex switching elements being connected to one of the pixels for a jth color component ($1 \leqq j \leqq 3$, j is an integer), the method comprising:

providing a first switching element connected between the data line and a first power supply line to which a first power supply voltage is supplied, and a second switching element connected between the data line and a second power supply line to which a second power supply voltage is supplied;

determining a length of a first divisional period and a length of a second divisional period after the first divisional period within a first precharge period which is provided before a drive period in which a polarity of a drive voltage corresponding to display data is negative with respect to a reference potential, based on at least a part of the first to third color component data of the display data in a second horizontal scanning period which is immediately before a first horizontal scanning period, the first divisional period and the second divisional period are in the first horizontal scanning period, the first precharge period including a period in which each of the data signal supply lines is electrically connected to one of the data lines each of which is connected to one of the pixels for first to third color components by the first to third demultiplex switching elements;

setting the first switching element in an ON state and setting the second switching element in an OFF state in the first divisional period, and setting the first switching element in an OFF state and setting the second switching element in an ON state in the second divisional period; and setting the first switching element and the second switching element in an OFF state after the first precharge period and driving the data lines by using the drive voltage.

23. The drive method as defined in claim 22, wherein the first divisional period is longer than the second divisional period.

24. A method of supplying data to a data line of a display panel, the method comprising:

providing a first switching element connected between the data line and a first power supply line to which a first power supply voltage is supplied, and a second switching element connected between the data line and a second power supply line to which is supplied a second power supply voltage which is lower than the first power supply voltage; and determining a length of a third divisional period and a length of a fourth divisional period after the third divisional period within a second precharge period which is provided before a drive period in which a polarity of a drive voltage corresponding to the data is positive with respect to a reference potential, based on at least a part of the display data in a second horizontal scanning period which is immediately before a first horizontal scanning period, the third divisional period and the fourth divisional period are in the first horizontal scanning period;

setting the first switching element in an OFF state and setting the second switching element in an ON state in the, third divisional period, and setting the first switching element in an ON state and setting the second switching element in an OFF state in the fourth divisional period; and setting the first switching element and the second switching element in an OFF state after the second precharge period and supplying the data to the data line by using the drive voltage.

25. The drive method as defined in claim 24, wherein the third divisional period is longer than the fourth divisional period.

26. A method of driving a plurality of data lines of a display panel, the display panel including: a plurality of scanning lines; the data lines; a plurality of pixels each of which is connected to one of the scanning lines and one of the data lines; and a plurality of demultiplexers each of which includes first to third demultiplex switching elements which are respectively and exclusively controlled by first to third demultiplex control signals, one end of each of the first to third demultiplex switching elements being connected to oné of data signal supply lines to which time-divided drive voltages corresponding to first to third color component data are supplied, and the other end of each of the first to third demultiplex switching elements being connected to one of the pixels for a jth color component ($1 \leqq j \leqq 3$, j is an integer), the method comprising:

providing a first switching element connected between the data line and a first power supply line to which a first power supply voltage is supplied, and a second switching element connected between the data line and a second power supply line to which a second power supply voltage is supplied;

determining a length of a third divisional period and a length of a fourth divisional period after the third divisional period within a second precharge period which is provided before a drive period in which a polarity of a drive voltage corresponding to display data is positive with respect to a reference potential, based on at least a part of the first to third color component data of the display data in a second horizontal scanning period which is immediately before a first horizontal scanning period, the third divisional period and the fourth divisional period are in the first horizontal scanning period, the second precharge period including a period in which each of the data signal supply lines is electrically connected to one of the data lines each of which is connected to one of the pixels for first to third color components by the first to third demultiplex switching elements;

setting the first switching element in an OFF state and setting the second switching element in an ON state in the third divisional period, and setting the first switching element in an ON state and setting the second switching element in an OFF state in the fourth divisional period; and setting the first switching element and the second switching element in an OFF state after the second precharge period and driving the data lines by using the drive voltage.

27. The drive method as defined in claim 26, wherein the third divisional period is longer than the fourth divisional period.

* * * * *

UNITED STATES PATENT AND TRADEMARK OFFICE

CERTIFICATE OF CORRECTION

PATENT NO. : 7,446,745 B2
APPLICATION NO. : 10/891146
DATED : November 4, 2008
INVENTOR(S) : Akira Morita It is certified that error appears in the above-identified patent and that said Letters Patent is hereby corrected as shown below:

Title page, item [54] and col. 1, insert -- Display Driver, Display Device, And Drive Method--

Signed and Sealed this

Twentieth Day of January, 2009

JON W. DUDAS
*Director of the United States Patent and Trademark Office*